US009346639B2

(12) United States Patent
Kim

(10) Patent No.: US 9,346,639 B2
(45) Date of Patent: May 24, 2016

(54) MEDIUM STORAGE BOX, MEDIUM HANDLING APPARATUS AND FINANCIAL DEVICE

(71) Applicant: LG N-SYS INC., Seoul (KR)

(72) Inventor: Do Wan Kim, Busan (KR)

(73) Assignee: LG CNS CO., LTD., Seoul (KR)

( * ) Notice: Subject to any disclaimer, the term of this patent is extended or adjusted under 35 U.S.C. 154(b) by 3 days.

(21) Appl. No.: 13/687,668

(22) Filed: Nov. 28, 2012

(65) Prior Publication Data

US 2013/0140756 A1 Jun. 6, 2013

(30) Foreign Application Priority Data

Dec. 2, 2011 (KR) ..... 10-2011-0128174
Nov. 15, 2012 (KR) ..... 10-2012-0129216

(51) Int. Cl.

| | |
|---|---|
| ***B65H 3/44*** | (2006.01) |
| ***B65H 5/26*** | (2006.01) |
| ***B65H 3/06*** | (2006.01) |
| ***G07D 11/00*** | (2006.01) |

(52) U.S. Cl.

CPC .. *B65H 3/44* (2013.01); *B65H 3/06* (2013.01); *B65H 3/0684* (2013.01); *G07D 11/0012* (2013.01)

(58) Field of Classification Search

CPC ..... B65H 3/00; B65H 3/02; B65H 3/06; B65H 3/0684; B65H 3/44; G07D 11/0012

USPC ..... 271/9.01, 9.07, 9.08, 9.11, 9.13, 10.13, 271/3.01, 3.05, 3.08, 162, 163, 165

See application file for complete search history.

(56) References Cited

U.S. PATENT DOCUMENTS

| | | | | | |
|---|---|---|---|---|---|
| 4,053,152 | A * | 10/1977 | Matsumoto | B65H 1/02 | 271/118 |
| 4,674,734 | A * | 6/1987 | Ibuchi | B65H 3/02 | 271/117 |
| 4,820,909 | A * | 4/1989 | Kawauchi | G07D 11/0081 | 235/379 |
| 6,022,013 | A * | 2/2000 | Foglino | B65H 3/44 | 271/9.08 |
| 6,135,438 | A * | 10/2000 | Newman | B65H 3/063 | 271/9.07 |
| 6,688,590 | B2 * | 2/2004 | Billings | B65H 3/44 | 271/9.05 |
| 7,976,005 | B2 * | 7/2011 | Ichikawa | B65H 31/24 | 271/3.01 |
| 2002/0014736 | A1 | 2/2002 | Katou et al. | | |

(Continued)

FOREIGN PATENT DOCUMENTS

| | | | |
|---|---|---|---|
| CN | 1707532 | A | 12/2005 |
| CN | 10-1465015 | A | 6/2009 |
| CN | 2014-89596 | U | 5/2010 |

(Continued)

OTHER PUBLICATIONS

European Search Report dated Apr. 18, 2013 in European Application No. 12194986.1, filed Nov. 30, 2012.

(Continued)

*Primary Examiner* — Prasad Gokhale

(74) *Attorney, Agent, or Firm* — Saliwanchik, Lloyd & Eisenschenk

(57) ABSTRACT

A medium storage box is provided. The medium storage box includes a first supporting plate for storing first medium, a second supporting plate spaced apart from the first supporting plate, for storing second medium, and a pickup roller, disposed between the first supporting plate and the second supporting plate, for selectively picking up one of the first medium and the second medium.

21 Claims, 21 Drawing Sheets

(56) References Cited

U.S. PATENT DOCUMENTS

| | | | | |
|---|---|---|---|---|
| 2011/0074098 | A1 | 3/2011 | Ichikawa et al. | |
| 2012/0175836 | A1 * | 7/2012 | Meier | B65H 1/04 271/3.19 |

FOREIGN PATENT DOCUMENTS

| | | | | |
|---|---|---|---|---|
| EP | 1603085 | A1 | | 12/2005 |
| JP | 55123833 | A | * | 9/1980 |
| JP | S55-123833 | A | | 9/1980 |
| JP | 62088737 | A | * | 4/1987 |
| JP | S62-88737 | A | | 4/1987 |
| JP | 63-185736 | A | | 8/1988 |
| JP | 1995-137870 | A | | 5/1995 |
| JP | 2002-008098 | A | | 1/2002 |
| JP | 2009-098835 | A | | 5/2009 |
| KR | 1991-008806 | B1 | | 10/1991 |
| KR | 10-0232988 | B1 | | 12/1999 |
| KR | 10-0960666 | B1 | | 6/2010 |
| KR | 10-2011-0012910 | A | | 2/2011 |
| KR | 10-2011-0017317 | A | | 2/2011 |
| WO | WO-2011/035138 | A1 | | 3/2011 |

OTHER PUBLICATIONS

Notice of Allowance dated Jun. 21, 2013 in Korean Application No. 10-2011-0128174, filed Dec. 2, 2011.

Japanese Office Action, dated Nov. 12, 2013, in Japanese Application No. 2012-264368.

Korean Office Action, dated Nov. 27, 2013, in Korean Application No. 10-2012-0129216.

Office Action, dated Jul. 14, 2014 in Chinese Application No. 201210510152.7.

* cited by examiner

MEDIUM STORAGE BOX, MEDIUM HANDLING APPARATUS AND FINANCIAL DEVICE

CROSS-REFERENCE TO RELATED APPLICATIONS

This application claims the benefit under 35 U.S.C. 119 of Korean Patent Application Nos. 10-2011-0128174, filed Dec. 2, 2011 and 10-2012-0129216, filed on Nov. 15, 2012, which are hereby incorporated by reference in their entirety.

BACKGROUND

The present disclosure relates to a medium storage box, a medium handling apparatus, and a financial device.

Generally, financial devices provide desired financial services to customers. Financial apparatuses may input/output media or automatically transfer media. As an example, financial apparatuses may allow inputting or outputting banknotes or checks.

A financial device includes a plurality of medium storage boxes to store media. Medium storage boxes may store a single kind of bills, respectively.

Since such conventional medium storage boxes store a single kind of bills, respectively, in order to store various kinks of bills in the financial device, there should be provided medium storage boxes corresponding to the number of kinds of bills. Accordingly, when including medium storage boxes corresponding to the number of the kinds of bills to store all kinds of bills, the size of a financial device increases. On the contrary, to maintain the size of a financial device, the number of kinds of bills to be stored is limited.

BRIEF SUMMARY

Embodiments provide a medium storage box, a medium handling apparatus, and a financial device.

In one embodiment, a medium storage box comprises: a first supporting plate for storing first medium; a second supporting plate spaced apart from the first supporting plate, for storing second medium; and a pickup roller, disposed between the first supporting plate and the second supporting plate, for selectively picking up one of the first medium and the second medium.

In another embodiment, a medium handling apparatus comprises: a plurality of medium storage spaces; a plurality of supporting plates, provided in the plurality of medium storage spaces, supporting medium; and a pickup roller, relatively movable with the plurality of supporting plates, for selectively picking up medium supported by the plurality of supporting plates.

In still another embodiment, a financial device comprises: a body where a medium input/output unit is formed; and a medium storage box mounted on the body, wherein the medium storage box includes a plurality of medium storage spaces for storing a plurality of media being divided, and the media stored in the plurality of medium storage spaces are picked up by a single pickup roller and are capable of being discharged from the medium storage box.

The details of one or more embodiments are set forth in the accompanying drawings and the description below. Other features will be apparent from the description and drawings, and from the claims.

DETAILED DESCRIPTION

Figure 1:
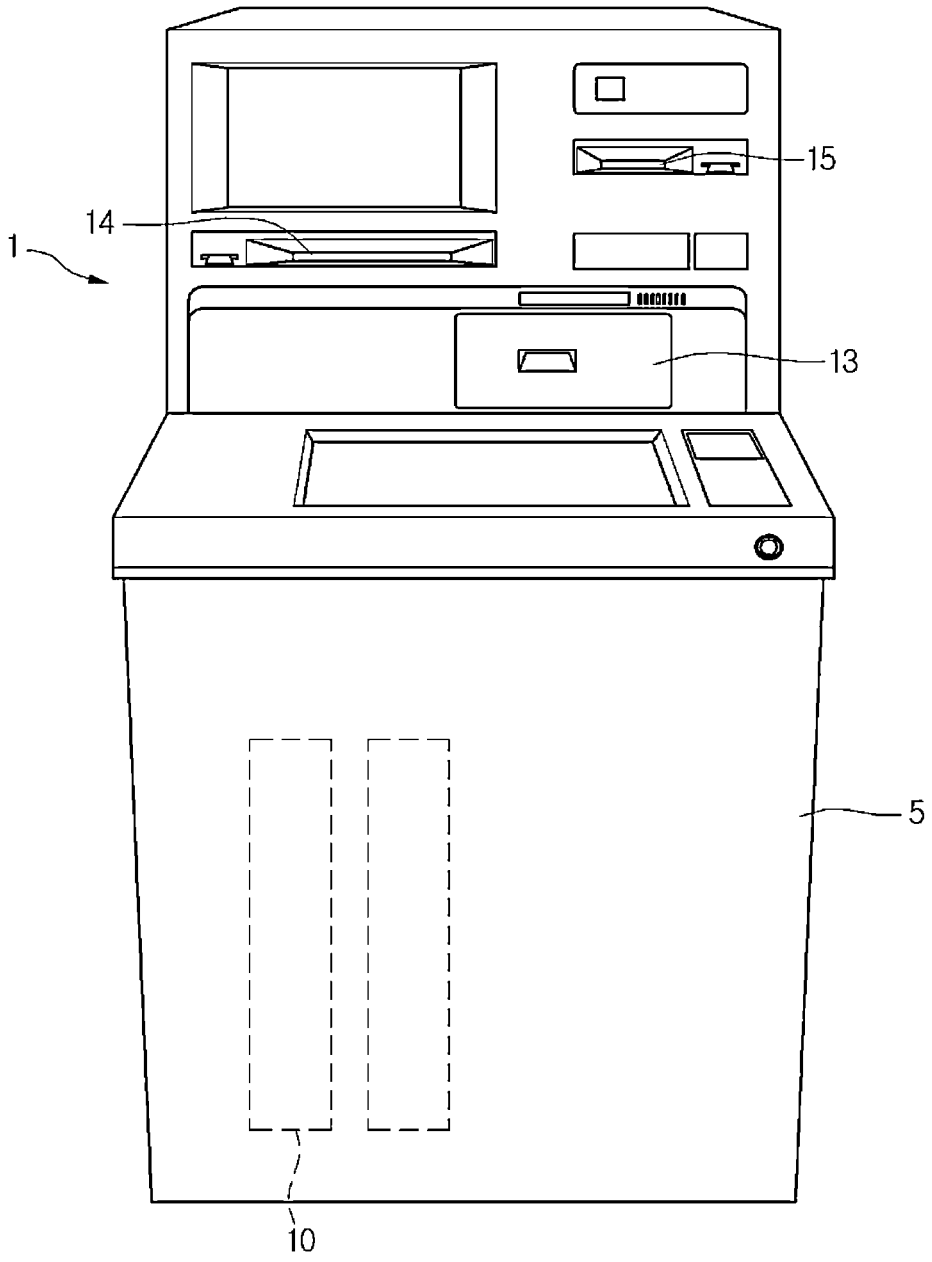
FIG. 1 is a perspective view illustrating a financial device according to an embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial device according to embodiments is a device that performs financial businesses, i.e., medium processing including processing such as deposit processing, giro receipt, or gift certificate exchange and/or processing such as withdrawal processing, giro dispensing, or gift certificate dispensing by receiving various media such as, e.g., paper moneys, bills, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial businesses such as a financial information system (FIS).

Hereinafter, assuming that the financial device is the ATM, an embodiment will be described. However, this assumption is merely for convenience of description, and technical idea of the present disclosure is not limited to the ATM.

FIG. 1 is a perspective view illustrating a financial device 1 according to an embodiment.

Referring to FIG. 1, the financial device 1 comprises a body 5 in which a plurality of components are installed. The body 5 may include a medium input/output unit 13 inputting or outputting medium, a bankbook input/output unit 14 for inputting or outputting a bankbook, a card input/output unit for inputting or outputting a card, and a plurality of medium storage boxes 10 for storing the medium.

Also, the financial device 1 may further include a sensing unit (not shown) for sensing a status of the medium. In the present embodiment, since a basic configuration of the financial device 1 may be embodied by well-known configurations, a detailed description thereof will be omitted.

One or more of the plurality of medium storage box 10 may store various kinds of medium.

Hereinafter, there will be described a configuration of the medium storage box 10 in detail.

Figure 2:
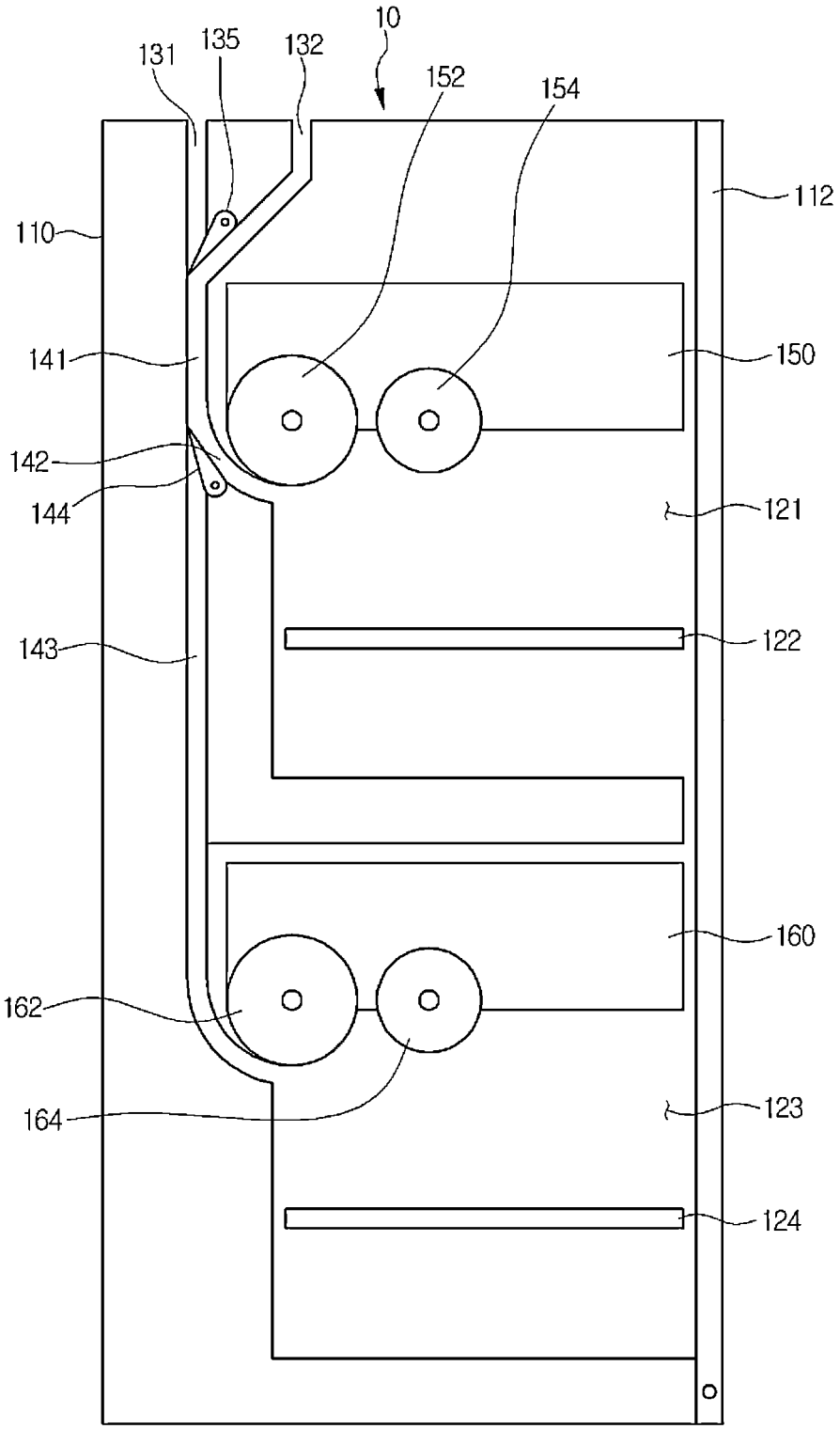
FIG. 2 is a schematic view illustrating an inner configuration of a medium storage box according to an embodiment.

FIG. 2 is a schematic view illustrating an inner configuration of the medium storage box.

Referring to FIG. 2, the medium storage box 10 may comprise a case 110 forming an exterior thereof and a cover 112 exposing and shielding an inner space of the case 110.

The case 110 may comprise a plurality of medium storage spaces 121 and 123 for storing medium. In FIG. 2, as an example, it is shown that the case 110 includes a first medium storage space 121 and a second medium storage space 123. However, the case 110 may include three or more medium storage spaces.

The first medium storage space 121 and the second medium storage space 123 are divided from each other and may be exposed and shielded at the same time by the cover 112. As another example, the respective medium storage spaces 121 and 123 may be individually exposed or shielded by a cover. In other words, a first cover may expose or shield the first medium storage space 121 and a second cover may expose or shield the second medium storage space 123.

In the present embodiment, different kinds of medium may be stored in the medium storage spaces 121 and 123, respectively. However, depending on a use of the financial device 1, the same kind of medium may be stored in the plurality of medium storage spaces 121 and 123. In this case, after storing a predetermined number of media in one medium storage space, the remaining medium may be stored in another medium storage space. Sizes of the plurality of medium storage spaces 121 and 123 may be the same or different from one another.

In the case 110, the first medium storage space 121 and the second medium storage space 123 may be arranged top and bottom. However, it is possible to arrange the first medium storage space 121 and the second medium storage space 123 right and left in the case 110.

The first medium storage space 121 includes a first supporter 122 for supporting media, and the second medium storage space 123 includes a second supporter 124 for supporting media. The first and second supporters 122 and 124 may be independently moved up and down in the medium storage spaces 121 and 123, respectively.

The case 110 may include a medium inlet 131 for accepting medium, a medium outlet 132 withdrawing the media, and a first diverter 135 controlling a transfer direction of the inserted or withdrawn media. The first diverter 135 may be operated by medium without an additional actuator when transferring the medium. As an example, in case that the first diverter 135 is designed to basically shield the medium inlet 131 by a self-weight thereof, medium may be transferred to transfer the first diverter 135 when the medium is being accepted. However, it is possible to drive the first diverter 135 using an actuator.

The medium inlet 131 and the medium outlet 132 are connected to a main path 141. The main path 141 branches off to a first transfer path 142 connected to the first medium storage space 121 and a second transfer path 143 connected to the second medium storage space 123. At a branch point of the first transfer path 142 and the second transfer path 143, there is provided a second diverter 144 controlling a transfer direction of the medium. The second diverter 144 may be operated by an actuator (not shown).

As an example, when a medium sensed by the sensing unit should be stored in the first medium storage space 121, the second diverter 144 blocks the second transfer path 143. Accordingly, the medium accepted inside the medium storage box 10 passes through the first transfer path and is stacked in the first medium storage space 121. On the contrary, when a medium sensed by the sensing unit should be stored in the second medium storage space 123, the second diverter 144 blocks the first transfer path 142. Accordingly, the medium accepted inside the medium storage box 10 passes through the second transfer path 143 and is stacked in the second medium storage space 123.

The medium storage box 10 further includes a first transfer module 150 and a second transfer module 160. The first transfer module 150 transfers a medium accepted inside the medium cassette 10 to the first medium storage space 121 or pickups a medium stored in the first medium storage space 121. The second transfer module 160 transfers a medium accepted inside the medium storage box 10 to the second medium storage space 123 or pickups a medium stored in the second medium storage space 123.

The first transfer module 150 includes a first feed roller 152 and a first pickup roller 154. The second transfer module 160 includes a second feed roller 162 and a second pickup roller 164. The respective transfer modules 150 and 160 may be mounted on the medium storage box 10 while being modulated. In the present embodiment, a part of the second transfer path 143 is vertically extended from the main path 141. Also, paths of positions of both the first transfer path 142 and the second transfer path 143 to insert medium into the second medium storage space 123 are identically located in a vertical direction. Accordingly, due to the arrangement of the main path and the first and second transfer paths 142 and 143, there is no lateral gap, based on FIG. 3, between the first medium storage space 121 and the second medium storage space 123.

Accordingly, without distinction, the first transfer module 150 and the second transfer module 160 may be mounted on the medium storage box 10, respectively. That is, in the present embodiment, according to a position where being mounted on, it is determined which one is the first transfer module 150 or the second transfer module 160. For example, after manufacturing a plurality of common transfer modules, it is possible to mount one of the common transfer modules on a side of the first medium storage space 121 and mount another on a side of the second medium storage space 123, and a case contrary thereto is possible.

However, respective transfer modules may further include separation rollers transferring media transferred to respective medium storage spaces in cooperation with respective feed rollers and transferring medium picked up by respective pickup rollers and transferred via respective transfer paths, respectively, which is not shown in the drawings.

While the first and second transfer modules 150 and 160 are being mounted on, the first and second feed rollers 152 and 162 may be driven by a single driving unit. That is, a belt is connected to the single driving unit and the belt is connected to the first and second feed rollers 152 and 162. On the contrary, the first and second pickup rollers 154 and 164 may be independently driven by separate driving units. However, the first and second feed rollers 152 and 162 may be independently driven separate driving units and the first and second pickup rollers 154 and 164 may be connected to each other by a belt and like and be driven by a single driving unit.

Hereinafter, there will be described processes of inserting and withdrawing medium into and from the medium storage box 10.

Figure 3:
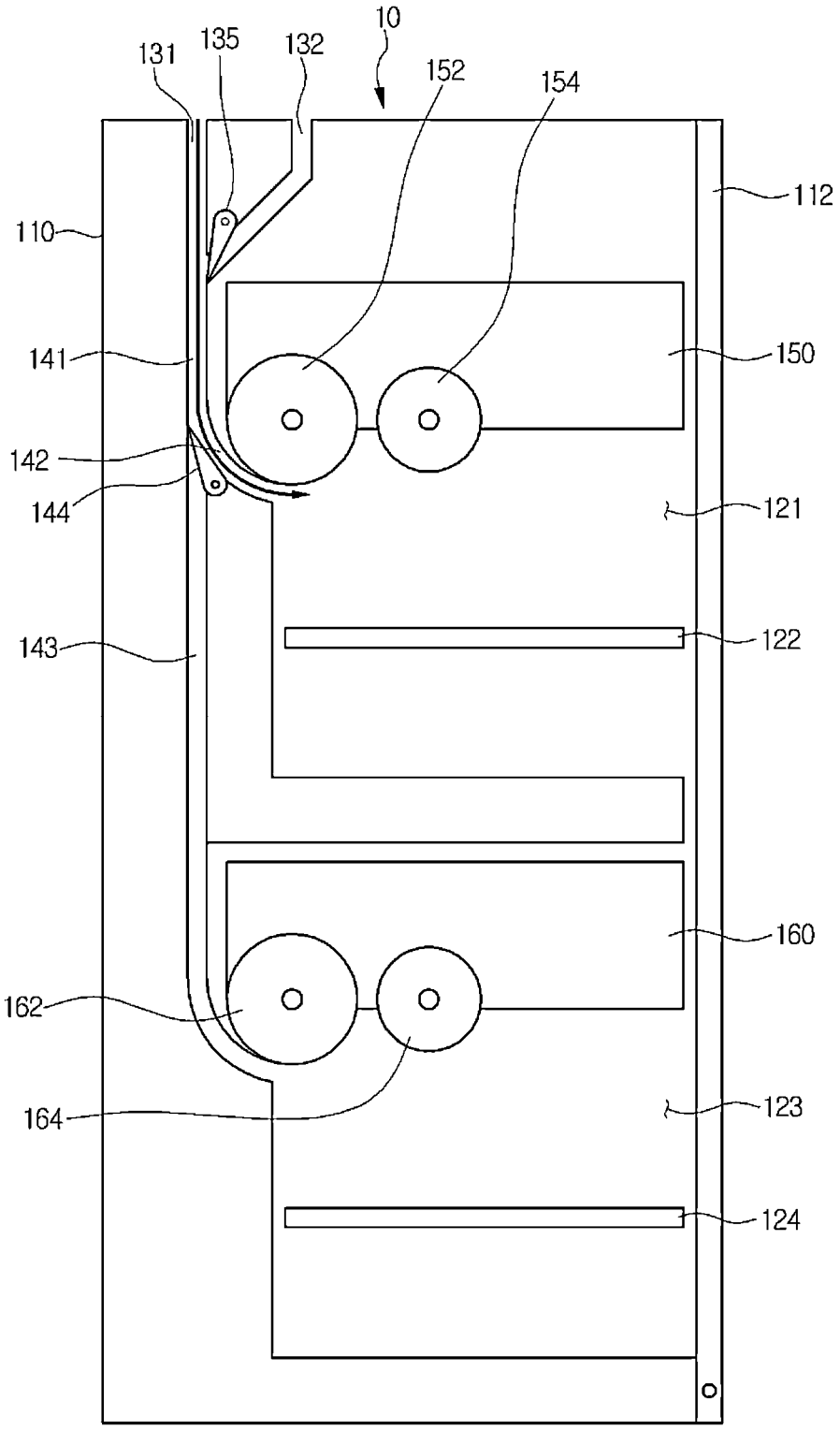
FIG. 3 is a view illustrating a process of accepting a medium into a first medium storage space.
Figure 4:
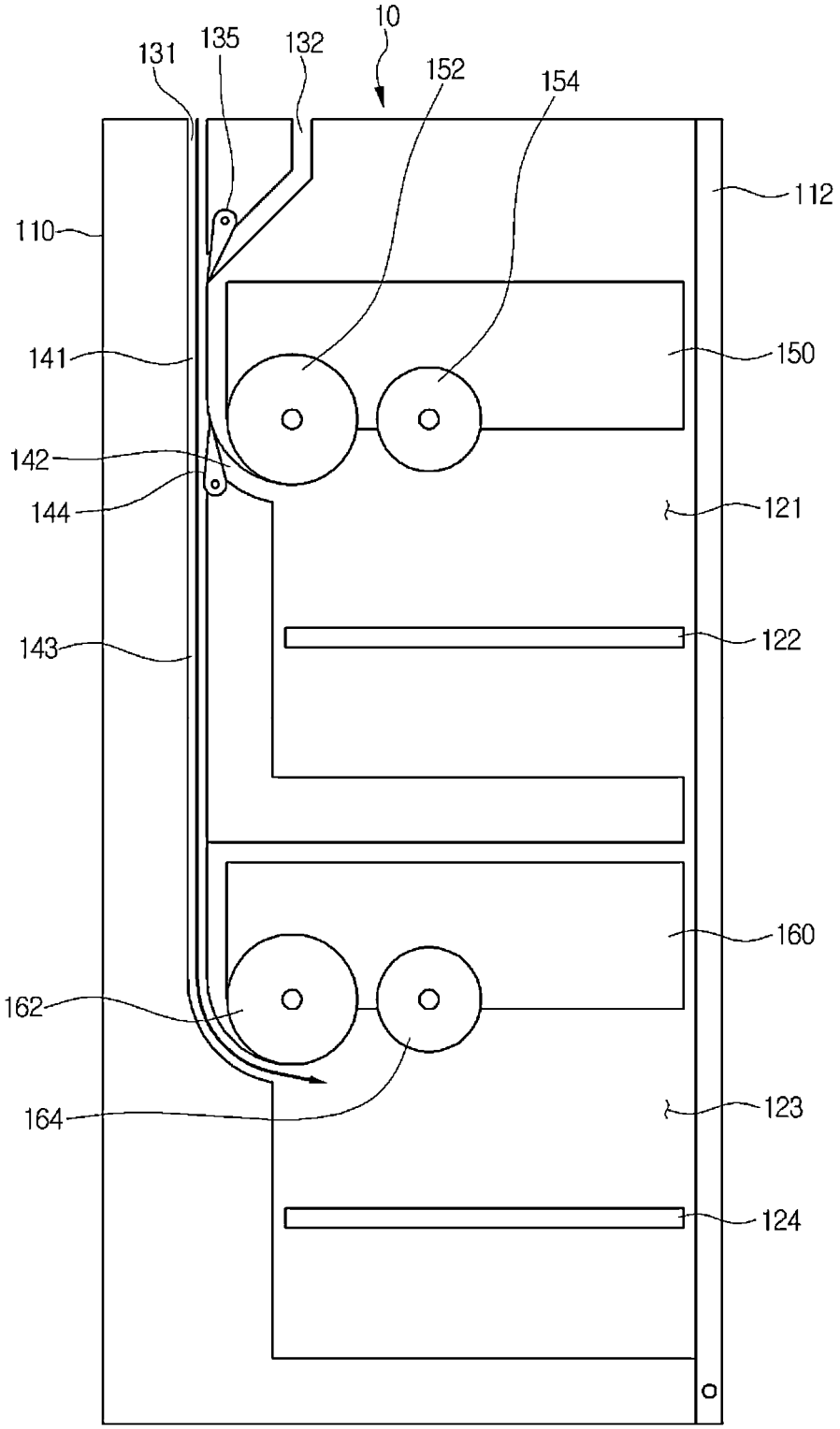
FIG. 4 is a view illustrating a process of accepting a medium into a second medium storage space.
Figure 5:
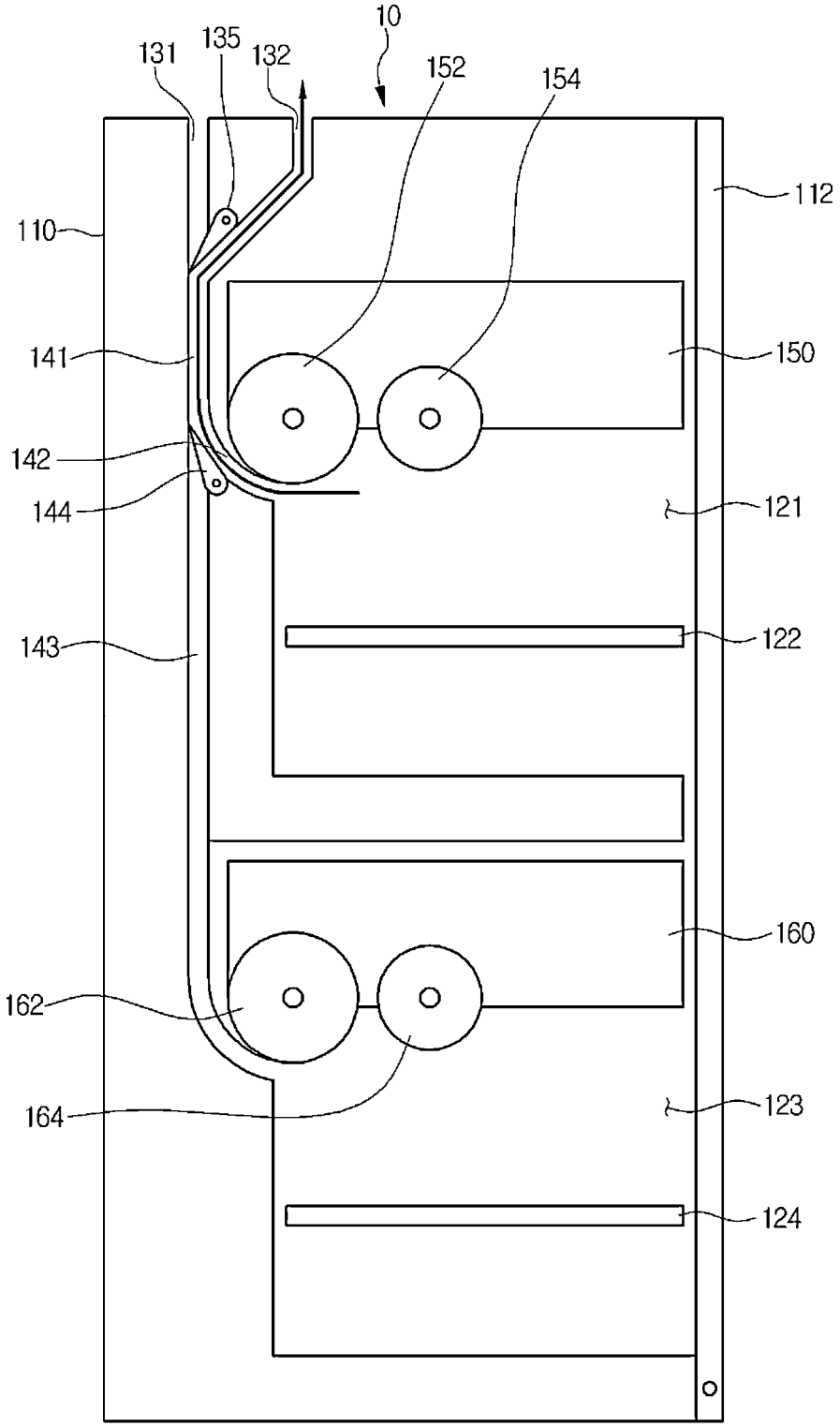
FIG. 5 is a view illustrating a process of withdrawing the medium stored in the first medium storage space.
Figure 6:
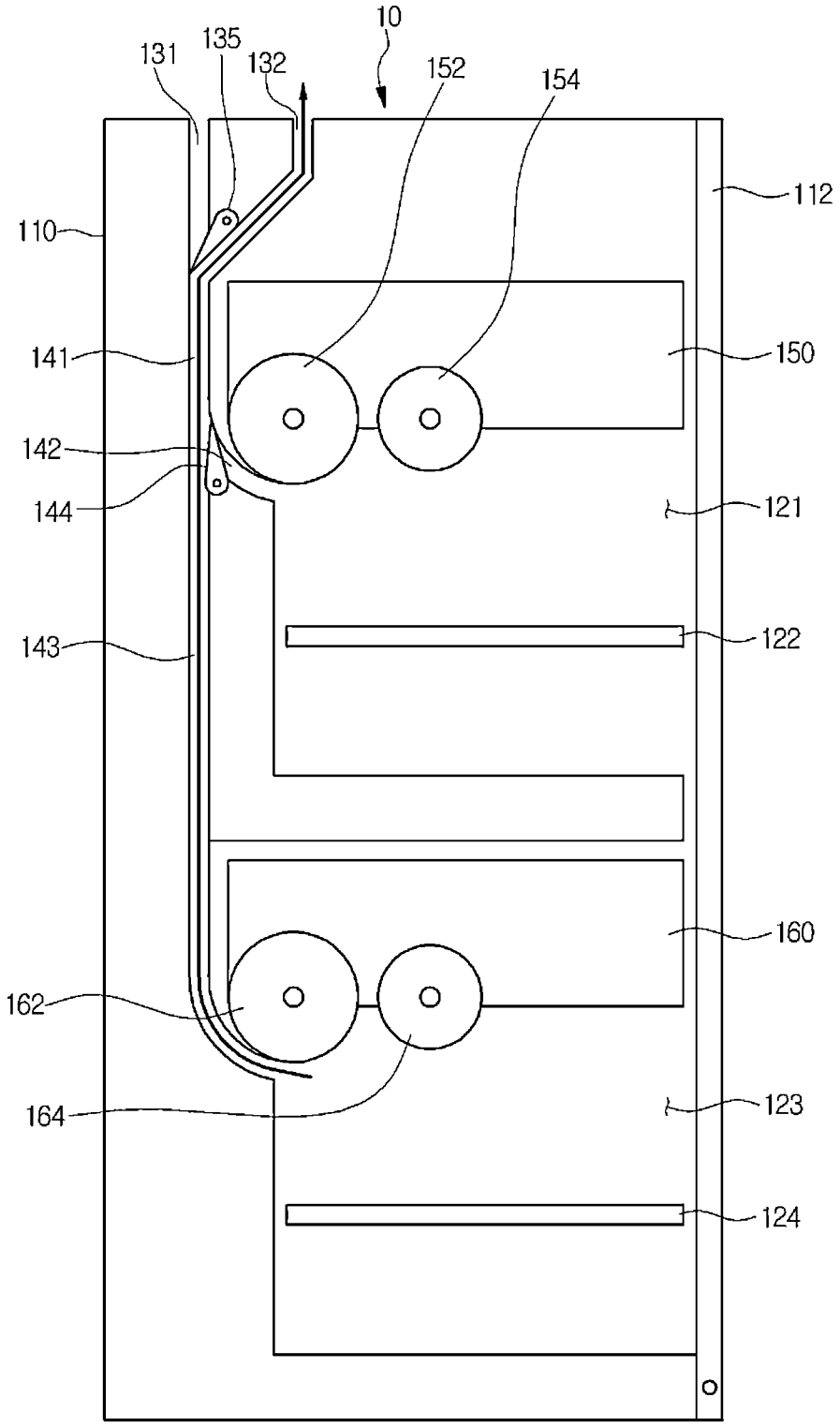
FIG. 6 is a view illustrating a process of withdrawing the medium stored in the second medium storage space.

FIG. 3 is a view illustrating a process of accepting a medium into the first medium storage space 121, FIG. 4 is a view illustrating a process of accepting a medium into the second medium storage space 123, FIG. 5 is a view illustrating a process of withdrawing the medium stored in the first medium storage space 121, and FIG. 6 is a view illustrating a process of withdrawing the medium stored in the second medium storage space 123.

Referring to FIG. 3, as a result of sensing a state of a medium at the sensing unit, when the medium should be stored in the first medium storage space 121, the second diverter 144 blocks the second transfer path 143. The medium inserted via the medium inlet 131 pushes the first diverter 135 and is transferred to the main path 141. The medium transferred to the main path 141 is transferred along the first transfer path 142 by the second diverter 144 and accepted into the first medium storage space 121.

Referring to FIG. 4, as a result of sensing a medium by the sensing unit, when the medium should be stored in the second medium storage space 123, the second diverter 144 blocks the first transfer path 142. The medium inserted via the medium inlet 131 pushes the first diverter 135 and is transferred to the main path 141. The medium transferred to the main path 141 is transferred along the second transfer path 143 downwardly and accepted into the second medium storage space 123.

Referring to FIG. 5, when a medium stored in the first medium storage space 121 should be withdrawn, the second diverter 144 opens the first transfer path 142. Also, the first pickup roller 154 is rotated clockwise and picks up the medium stacked on the first supporter 122. The picked up medium is transferred along the first transfer path 142 and the main path 141, transferred to the medium outlet 132 by the first diverter 135, and is withdrawn outside the medium storage box 10.

Referring to FIG. 6, when a medium stored in the second medium storage space 123 should be withdrawn, the second diverter 144 opens the second transfer path 143. Also, the second pickup roller 164 is rotated clockwise and picks up the medium stacked on the second supporter 124. The picked up medium is transferred along the second transfer path 143 and the main path 141, transferred to the medium outlet 132 by the first diverter 135, and withdrawn outside the medium storage box 10.

As described above, according to the present embodiment, since there are provided a plurality of the medium storage spaces 121 and 123 divided inside the medium storage box 10, it is possible to store various kinds of media inside a single medium storage box.

As various kinds of media are stored inside a medium cassette, the number of kinds of storable media may be increased without an increase of the size of the financial device 1.

In addition, without a change in a configuration of the financial apparatus 1, an existing medium storage box including a single medium storage space may be replaced by a medium storage box including a plurality of medium storage spaces.

Figure 7:
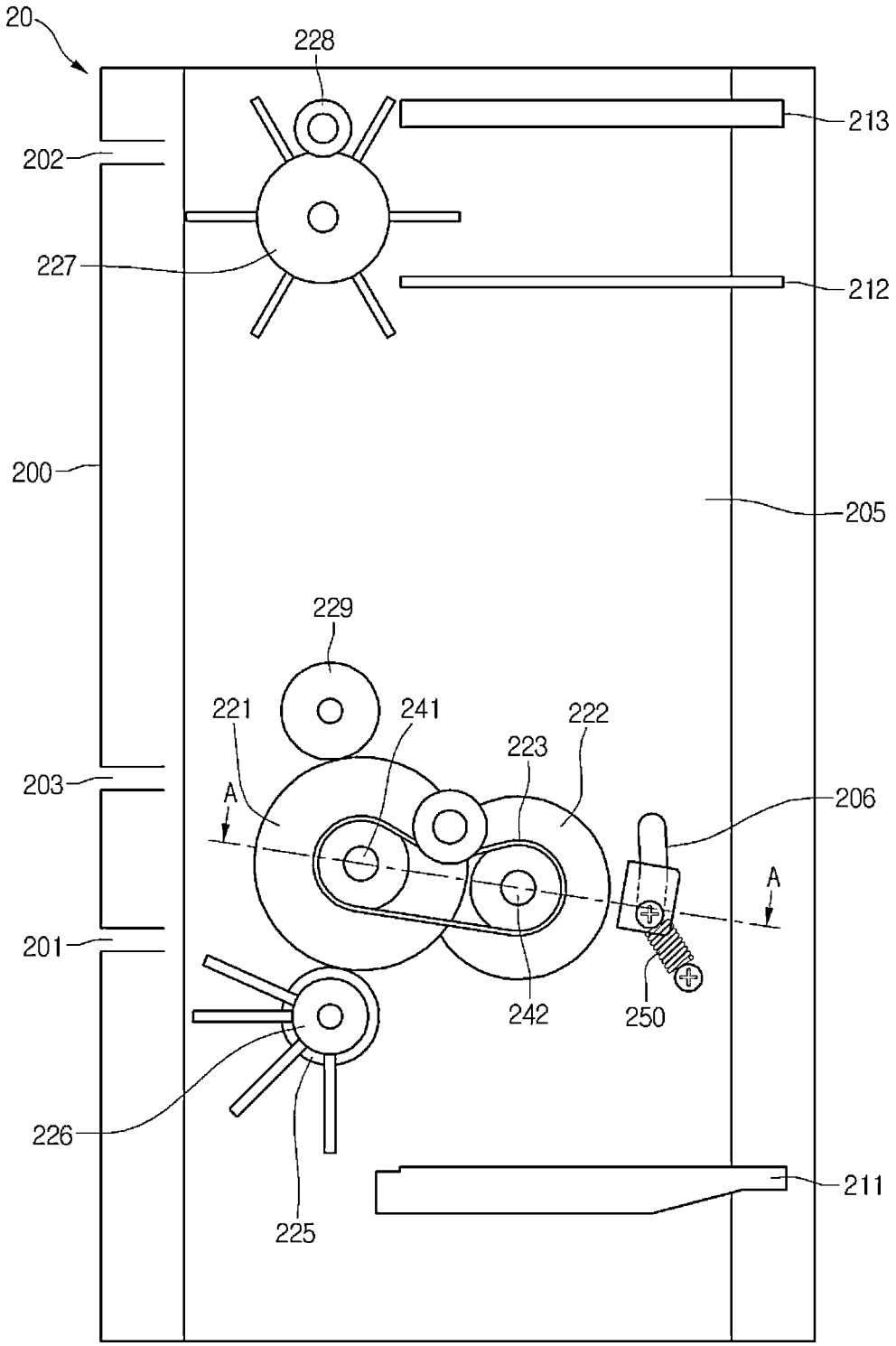
FIG. 7 is a schematic view illustrating an inner configuration of a medium storage box according to another embodiment.
Figure 8:
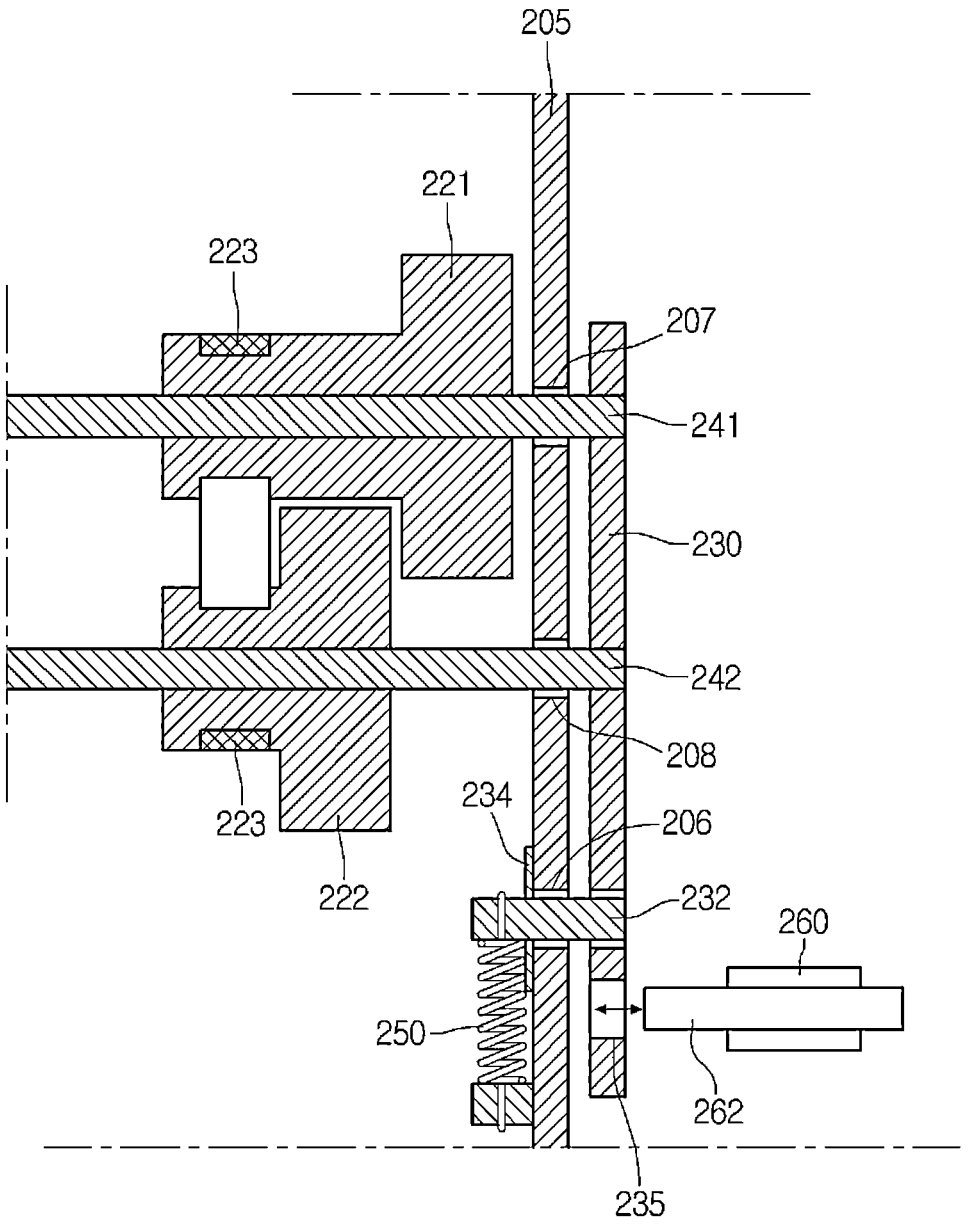
FIG. 8 is a cross-sectional view illustrating the medium storage box of FIG. 7 cut along a line A-A in FIG. 7.

FIG. 7 is a schematic view illustrating an inner configuration of a medium storage box 20 according to another embodiment, and FIG. 8 is a cross-sectional view illustrating the medium storage box 20 cut along a line A-A in FIG. 7.

Referring to FIGS. 7 and 8, the medium storage box 20 includes a housing 200 forming an exterior thereof.

The housing 200 includes a first path 201 for accepting and withdrawing a first medium, a second path 202 for transferring a second medium when accepting the second medium, and a third path 203 for transferring the second medium when withdrawing the second medium. The first medium may be accepted in a first medium storage space and be withdrawn therefrom via the first path 201. On the contrary, the second medium may be accepted in a second medium storage space via the second path 202 and be withdrawn from the second medium storage space via the third path 203.

Also, the housing includes a first supporting plate 211 for supporting the first medium and a second supporting plate 212 for supporting the second medium. Accordingly, in the present embodiment, it may be considered that the medium storage box 20 includes a plurality of medium storage spaces for storing medium that divided each other.

In this case, in the plurality of medium storage spaces, the same kind of media or different kinds of media may be stored, respectively. Otherwise, in the plurality of medium storage spaces, media in mutually different states may be stored. For example, a medium sensed by a sensing unit (not shown) to be a normal state may be stored in the first medium storage space and a medium sensed by the sensing unit to be an abnormal state or a medium unclaimed by a customer may be stored in the second medium storage space. In the present embodiment, there is no limit on kind or state of media stored in the respective storage spaces.

The second supporting plate 212 is arranged on top of the first supporting plate 211. That is, the first supporting plate 211 and the second supporting plate 212 are arranged vertically. However, it is possible to laterally arrange the first supporting plate 211 and the second supporting plate 212. When the first supporting plate 211 and the second supporting plate 212 are arranged vertically, the third path 203 may be located on top of the first path 201 and the second path 202 may be located on top of the third path 203. In other words, the third path 203 may be arranged between the first path 201 and the second path 202.

The first supporting plate 211 and the second supporting plate 212 may be moved up and down inside the medium storage box 20 by separate driving units.

The medium storage box 20 includes a first feed roller 221 and a first gate roller 225 for inputting the first medium and a pickup roller 222 for picking up one of the first medium and the second medium stored therein to withdraw the same. As an example, the first gate roller 225 may receive a rotational force from the first feed roller 221 and be rotated in a direction opposite to that of the first feed roller 221. In the present embodiment, since methods of rotating the first feed roller 221 and the first gate roller 225 may be embodied by well-known configurations, a detailed description thereof will be omitted.

The pickup roller 222 and the first feed roller 221 may be connected by a belt 223. As another example, the pickup roller 222 and the first feed roller 221 may be driven by separate driving units.

To selectively pick up one of the first medium and the second medium, the pickup roller 222 may be arranged between the first supporting plate 211 and the second supporting plate 212.

To a rotation axis of the first gate roller 225, there may be connected a sheet roller 226 hitting the first medium in such a way that the first medium easily falls downwardly to the first supporting plate 211.

Also, the medium storage box 20 may further include a second feed roller 227 and a second gate roller 228 for accepting the second medium, a transfer roller 229 for withdrawing the second medium in cooperation with the first feed roller 221, and a pushing plate 213 for pushing the second medium when the second medium is withdrawn.

For example, the second feed roller 227 may be rotated by receiving a rotational force from the first feed roller 221 or be rotated by a separate driving unit different from that of the first feed roller 221. Also, for example, the second gate roller 228 may be rotated in an opposite direction from that of the second feed roller 227 by receiving a rotational force from the second feed roller 227 or be rotated due to a frictional force with the inserted second medium.

The pushing plate 213 is arranged on top of the second supporting plate 212. The pushing plate 213 pushes the second medium stored on the second supporting plate 212 toward the pickup roller 222 when withdrawing the second medium. The pushing plate 213 may be moved up and down by a different driving unit from that driving the second supporting plate 212.

Referring to FIG. 8, a first rotation axis 241 of the first feed roller 221 and a second rotation axis 242 of the pickup roller 222 penetrate a frame 205 provided in the housing 200. On the frame 205, there are formed a first hole 207 for the first rotation axis 241 and a second hole 208 for the second rotation axis 242 to penetrate the frame 205.

The first rotation axis 241 and the second rotation axis 242 penetrating the frame 205 are connected to a connecting plate 230. Accordingly, on the basis of the frame 205, the first feed roller 221 and the pickup roller 222 are arranged on one side (left in FIG. 8) and the connecting plate 230 is arranged on another side.

The connecting plate 230 includes a connecting pin 232. The connecting pin 232 is separated from the second rotation axis 242. The connecting pin 232 penetrates a pin hole 206 on the frame 205 and is engaged with an engaging plate 234. Also, the connecting pin 232 is connected to an elastic member 250.

The connecting plate 230 may be rotated on the first rotation axis 241. To allow the connecting pin 230 to be rotated on the first rotation axis 241, the second hole 208 and the pin hole 206 may be formed in the shape of an arc to allow the second rotation axis 242 and the connecting pin 232 to be transferable.

One end of the elastic member 250 may be connected to the connecting pin 232 and another end thereof may be connected to the frame 205 at a lower position than that of the connecting pin 232. Also, the elastic member 250 may be, as an example, a tensile spring.

To withdraw the second medium, the first supporting plate 211 may be moved upwardly and push the pickup roller 222 upwardly. Then, the connecting pin 230 may be rotated on the first rotation axis 241 counterclockwise in FIG. 7. In this case, the elastic member 250 is stretched, and when there is removed an external force, the elastic member 250 provides an elastic force to the connecting pin in a direction of being contracted.

Though the elastic member 250 directly provides an elastic force to the connecting pin 232, since the elastic force is transferred also to the connecting plate 230, it may be understood as the elastic member 250 provides the elastic force to the connecting plate 230.

As another example, the elastic member 250 may be a compression spring. In this case, one end of the elastic member 250 may be connected to the connecting pin 232 and another end thereof may be connected to the frame 205 at a higher position than that of the connecting pin 232. As still another example, the elastic member 250 may be directly connected to the connecting plate 230. In the present embodiment, there is no limit on a kind and a connecting position of the elastic member 250.

The medium storage box 20 may further include a fastening device to fasten a position of the connecting pin 230 when the connecting plate 230 is rotated counterclockwise. The fastening device may be, as an example, a solenoid 260. On the connecting plate 230, there may be formed a hole 235 for a fastening portion 262 included in the solenoid 260 to penetrate the connecting plate 230.

Hereinafter, there will be described processes of accepting and withdrawing a first medium M1 and a second medium M2.

Figure 9:
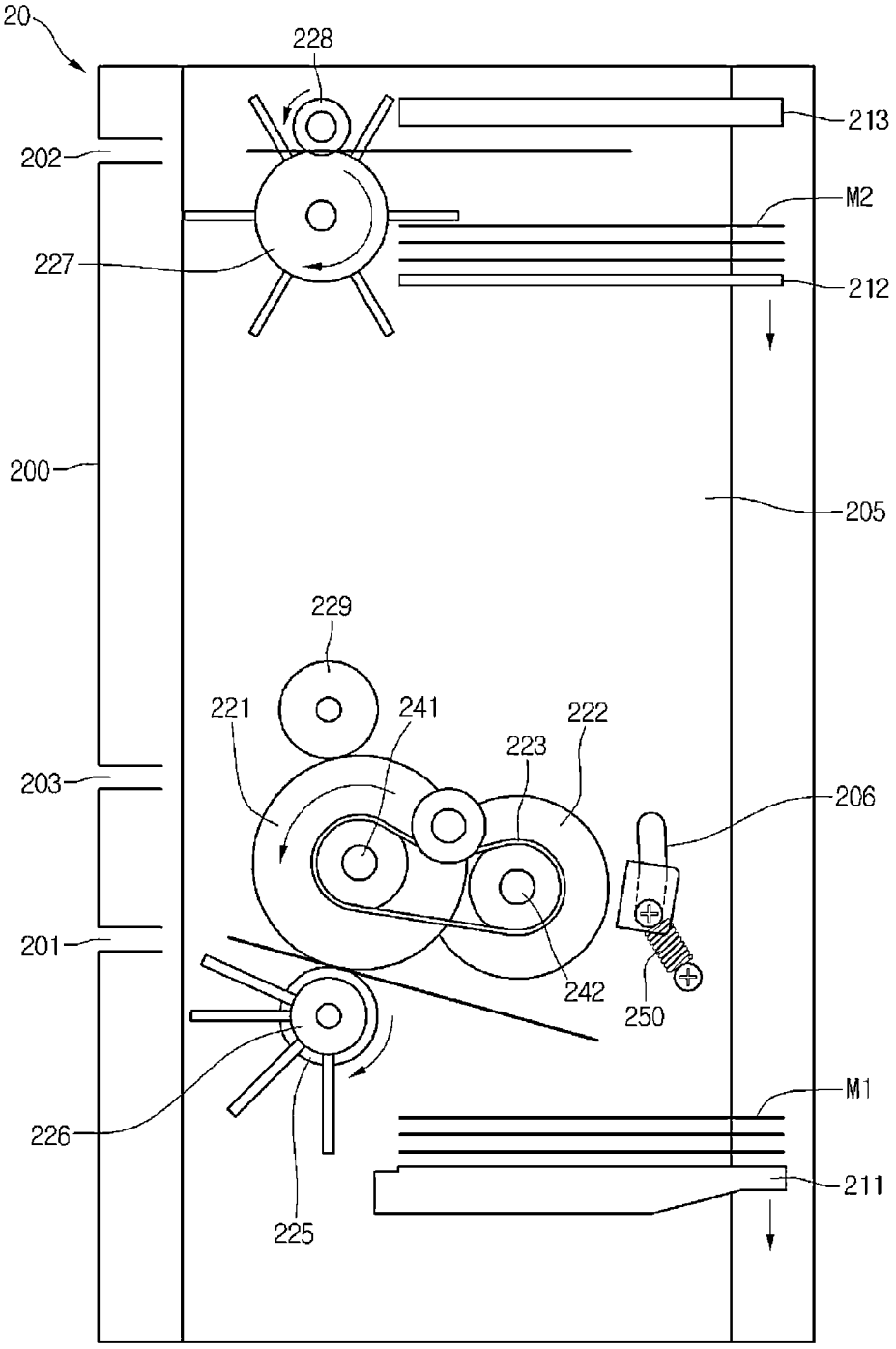
FIG. 9 is a view illustrating a process of accepting a first medium and a second medium according to another embodiment.

FIG. 9 is a view illustrating the process of accepting the first medium M1 and the second medium M2 according to another embodiment.

Though it is shown that the first medium M1 and the second medium M2 are accepted in the medium storage box 20 at the same time in FIG. 9, any one of the first medium and second medium M1 and M2 may be accepted first and another one thereof may be inserted later.

Referring to FIG. 9, the first medium M1 is accepted inside the housing 200 via the first path 201. The first medium M1 accepted inside the housing 200 is dropped on top of the first supporting plate 211 by the first feed roller 221 and the first gate roller 225. In this case, the first feed roller 221 is rotated counterclockwise in FIG. 9 and the first gate roller 225 is rotated clockwise. Also, as the number of inserted first media is increased, the first supporting plate 211 descends.

The second medium M2 is accepted inside the housing 200 via the second path 202. The second medium M2 accepted inside the housing 200 is dropped on the second supporting plate 212 by the second feed roller 227 and the second gate roller 228. In this case, the second feed roller 227 is rotated clockwise in FIG. 9 and the second gate roller 228 is rotated counterclockwise. Also, as the number of inserted second media is increased, the second supporting plate 212 descends.

Figure 10:
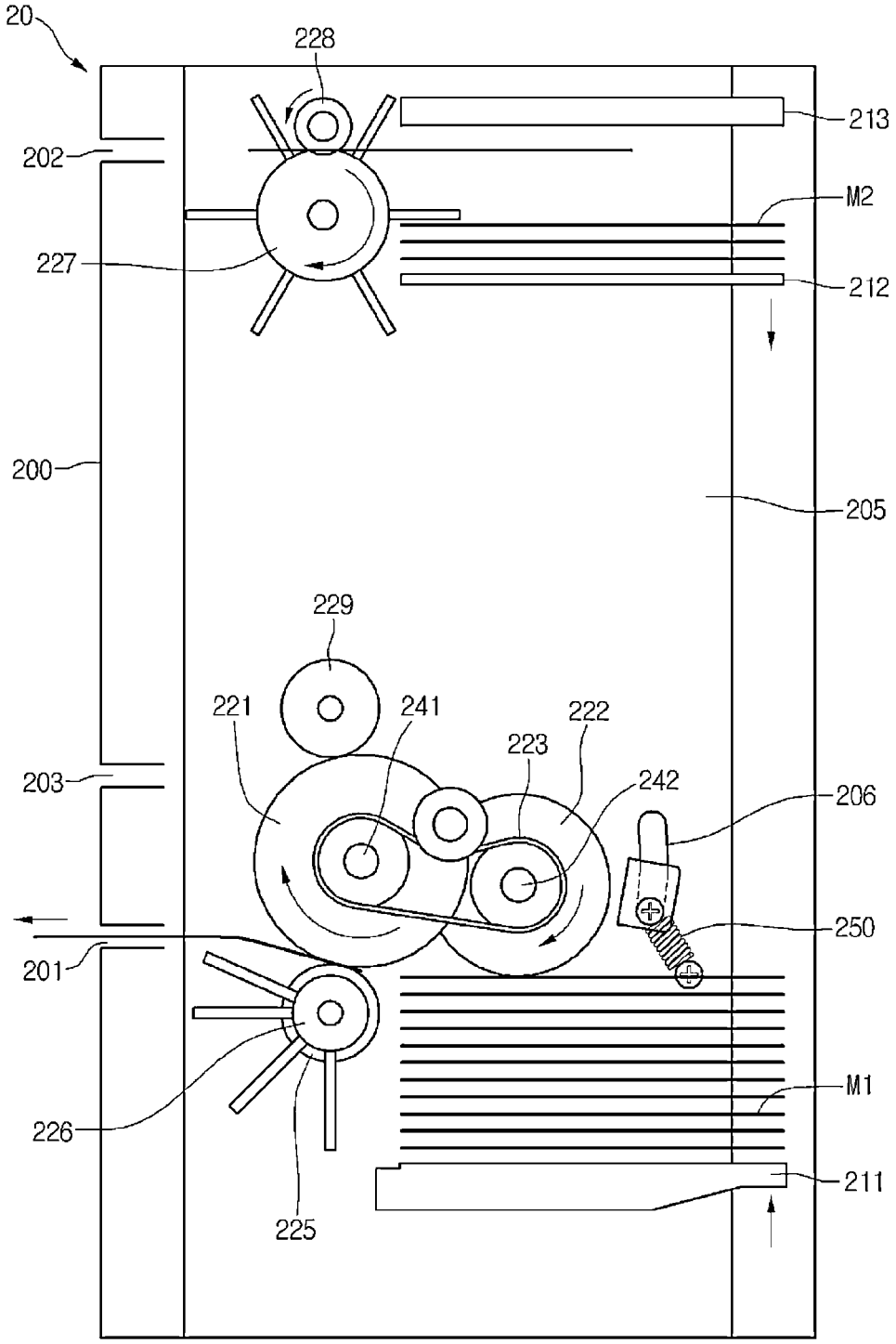
FIG. 10 is a view illustrating a process of withdrawing the first medium and accepting the second medium according to another embodiment.

FIG. 10 is a view illustrating processes of withdrawing the first medium M1 and accepting the second medium M2 according to another embodiment.

Though it is shown that the second medium M2 is accepted while the first medium M1 is being withdrawn, any one of the withdrawal of the first medium M1 and the insertion of the second medium M2 may be performed first and another one thereof may be performed later. Since a description of the process of accepting the second medium with reference to FIG. 10 is the same as that described with reference to FIG. 9, it will be omitted.

Referring to FIG. 10, to withdraw the stored first medium M1, the first supporting plate 211 ascends. The first supporting plate 211 ascends until the first medium M1 on the first supporting plate 211 is in contact with the pickup roller 222. Then, the first medium M1 on the first supporting plate 211 is picked up by the pickup roller 222 one by one, and the picked up first medium M1 is withdrawn outside the housing 200 via the first path 201. In this case, in FIG. 10, the pickup roller 222 and the first feed roller 221 are rotated clockwise (a first direction). When withdrawing the first medium M1, the second rotation axis 242 is located lower than the first rotation axis 241.

Figure 11:
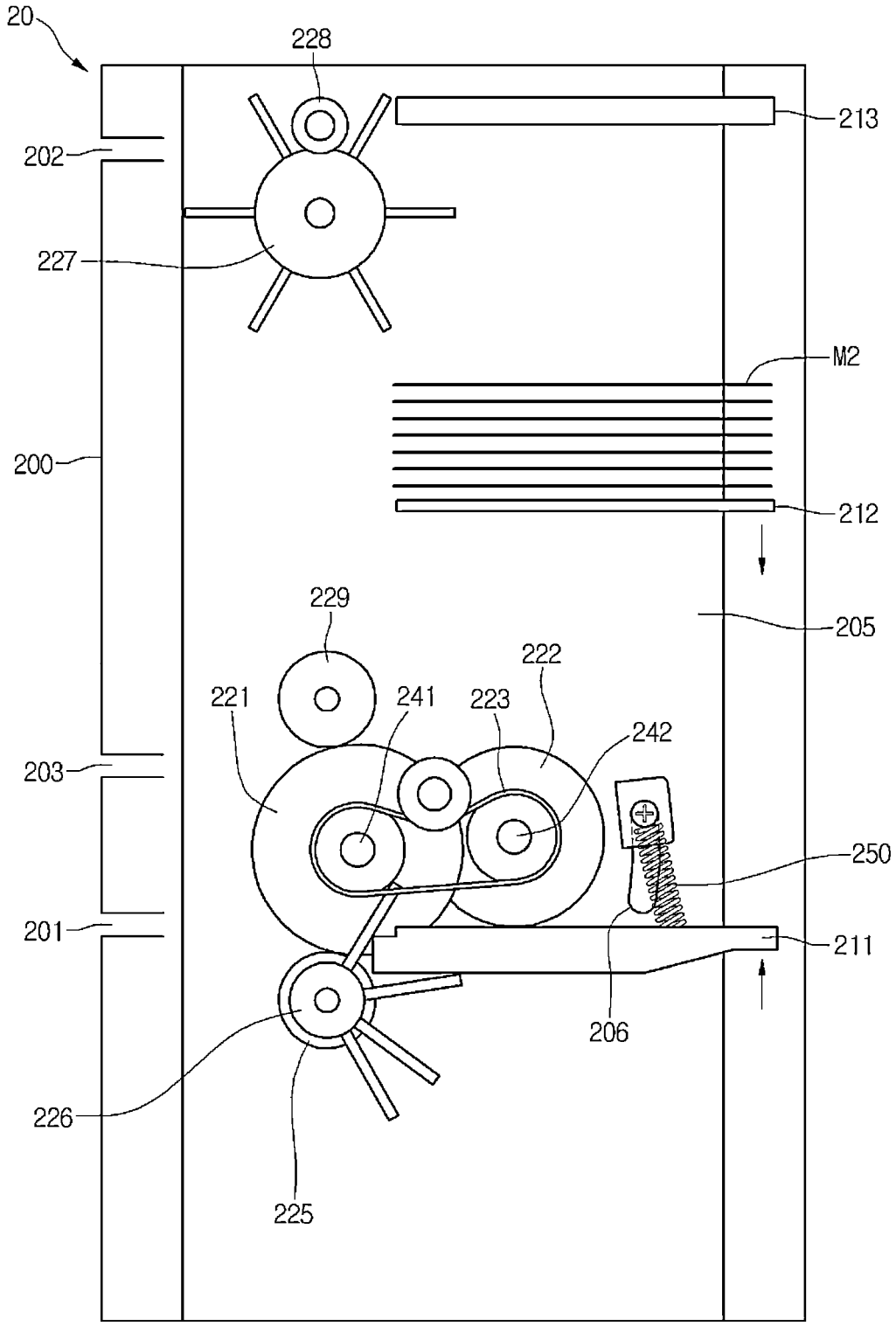
FIGS. 11 and 12 are views illustrating a process of withdrawing the second medium according to another embodiment.
Figure 12:
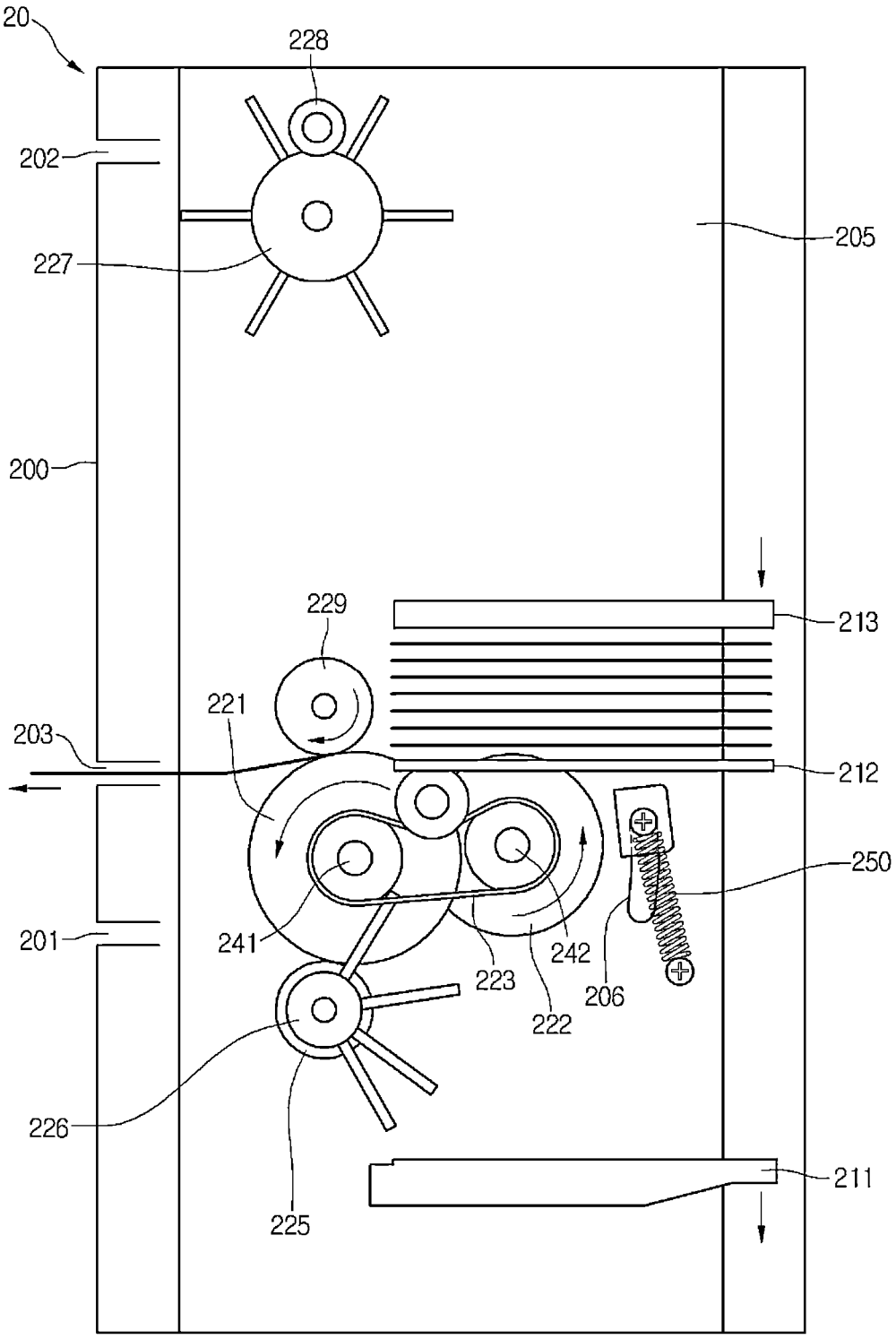

FIGS. 11 and 12 are views illustrating a process of withdrawing the second medium M2 according to another embodiment.

Referring to FIG. 11, to withdraw the second medium M2, the first supporting plate 211 is moved toward the pickup roller 222. In FIG. 11, the first supporting plate 211 ascends toward the pickup roller 222. While ascending, the first supporting plate 211 is in contact with the pickup roller 222 and the pickup roller 222 is lifted by a continuous ascent of the supporting plate 211. In this case, when the first medium M1 is not on the first supporting plate 211, the first supporting plate 211 is in contact with the pickup roller 222, and when the first medium M1 is put on the first supporting plate 211, the first medium M1 is in contact with the pickup roller 222. Accordingly, in the present embodiment, the first supporting plate 211 functions as a pickup roller transfer unit for transferring the pickup roller 222.

As described above, when the first supporting plate 211 pushes the pickup roller 222 upwardly, the connecting pin 230 connected to the pickup roller 222 is rotated counterclockwise on the first rotation axis 241.

As shown in FIG. 11, when the pickup roller 222 is lifted, the second rotation axis 242 is located higher than the first rotation axis 241. In the present embodiment, since the pickup roller 222 is lifted, the pickup roller may be relatively movable with the first and second supporting plates 211 and 212.

In the present embodiment, when the pickup roller 222 is lifted, a position where the pickup roller 222 stops may be sensed by a sensor (not shown). The sensor may one of the pickup roller 222, the second rotation axis 242, and the connecting plate 230.

When the pickup roller 222 is lifted to the stop position thereof, the fastening device is connected to the connecting plate 230. That is, the fastening portion 262 of the solenoid 260 penetrates the connecting plate 230, thereby fastening a position of the connecting plate 230.

Next, the first supporting plate 211 descends to be separated from the pickup roller 222. A reason of the separation of the first supporting plate 211 from the pickup roller 222 is to prevent interference between the first supporting plate 211 and the pickup roller 222 while the pickup roller 222 is picking up the second medium M2.

Next, the second supporting plate 212 is moved toward the pickup roller 222. In FIG. 11, the second supporting plate 212 descends toward the pickup roller 222.

On the second supporting plate 212, there is formed a hole (not shown) where the pickup roller 222 penetrates on a position corresponding to the pickup roller 222. Accordingly, when the second supporting plate 212 descends, the pickup roller 222 penetrates the hole and is in contact with the second medium M2. Accordingly, the second medium M2 may be picked up by the pickup roller 222.

In this case, to allow the pickup roller 222 to smoothly pick up the second medium M2, the pushing plate 213 descends and pushes the second medium M2 toward the pickup roller 222.

Then, finally, the second medium M2 is picked up by the pickup roller 222 one by one and the picked up second medium M2 is withdrawn outside the housing 200 via the third path 203.

In this case, the pickup roller 222 and the first feed roller 221 are rotated counterclockwise (a second direction) in FIG. 12 and the transfer roller 229 is rotated clockwise.

On the other hand, after an operation of picking up the second medium M2 is completed, it is released fastening the position of the connecting plate 230 by the fastening device. Then, due to the elastic force of the elastic member 250, the pickup roller 222 returns to an original position thereof. In other words, the elastic member 250 provides the elastic force to transfer the second rotation axis 242 of the pickup roller 222 toward the first supporting plate 211.

According to the present embodiment, since it is possible to pick up one of the first medium M1 and the second medium M2 by a single pickup roller 222, there is not needed an additional pick roller in such a way that capacity for storing media in the medium storage box 20 increases and the inner configuration of the medium storage box 20 becomes simplified.

In the present embodiment, since a diameter of the pickup roller 222 is formed to be smaller than that of the first feed roller 221, the second rotation axis 242 is located lower than the first rotation axis 241 to allow the first medium to be picked up. Accordingly, the pickup roller 222 is lifted to be used for picking up the second medium M2.

However, when a diameter of the pickup roller 222 is formed to be greater than that of the first feed roller 221, it is possible to pick up the second medium M2 without lifting the pickup roller 222. Merely, in this case, as a size of the pickup roller 222 increases, capacity for storing medium in the medium storage box 20 may be reduced.

In the present embodiment, though it has been described that the connecting plate 230 is connected to the first rotation axis 241 and the second rotation axis 242, it is possible to connect the connecting plate 230 only to the second rotation axis 242. Also in this case, since the pickup roller 222 is connected to the first feed roller 221 using the belt, the connecting pin 230 may be rotated on the first rotation axis 241.

As another example, respective supporting plates are horizontally arranged and a connecting plate where a pickup roller is installed is horizontally moved in such a way that the pickup roller may selectively pick up medium supported by the respective supporting plates. For example, the pickup roller transferred to a position corresponding to the first supporting plate may be moved to a position corresponding to the second supporting plate and pick up medium supported by the second supporting plate.

Also, among elements of the medium storage box 20, a configuration including at least a plurality of medium storage spaces, a plurality of supporting plates, and a pickup roller may be designated as a medium handling apparatus.

Figure 13:
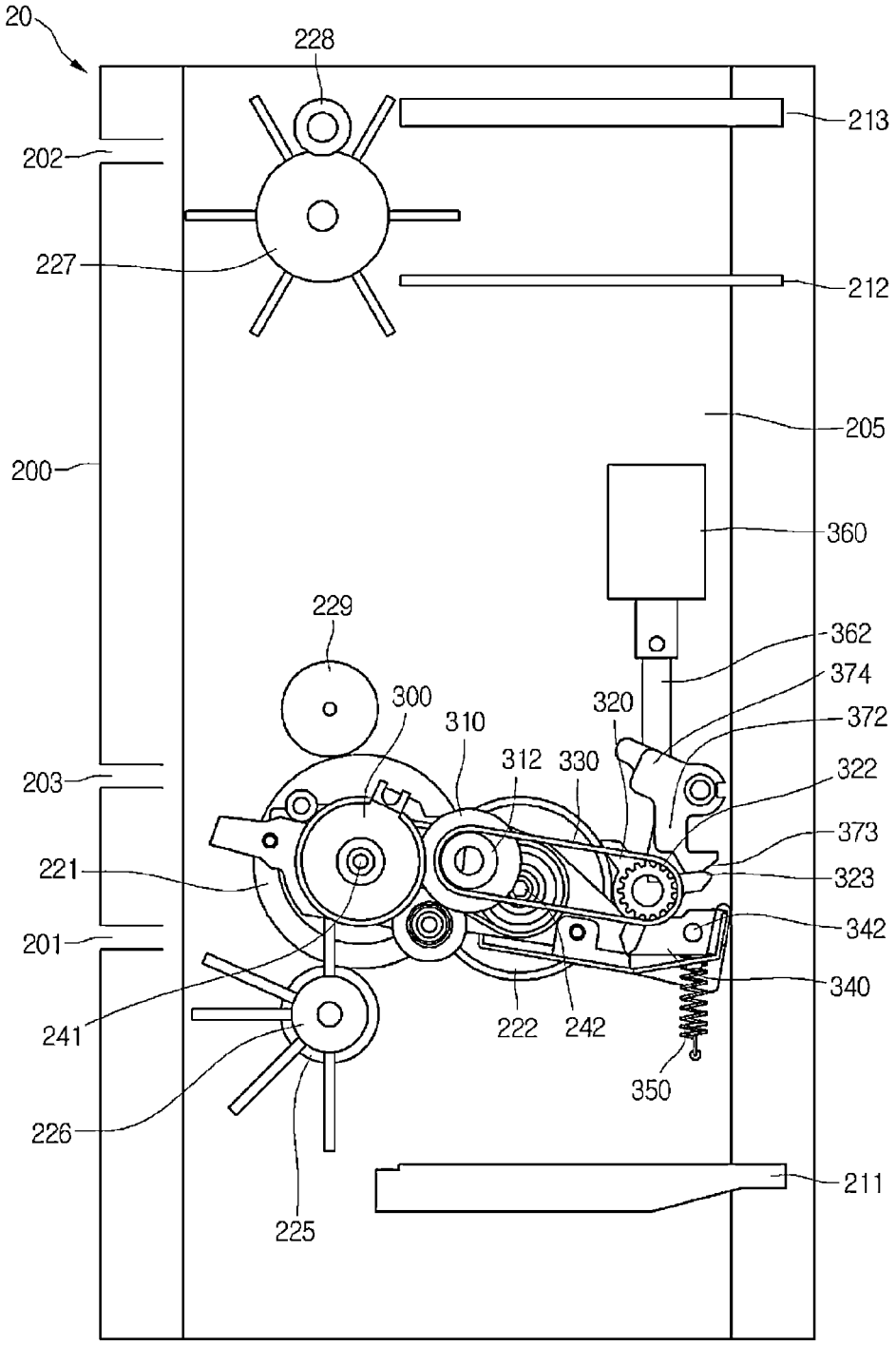
FIG. 13 is a schematic view illustrating an inner configuration of a medium storage box according to still another embodiment.
Figure 14:
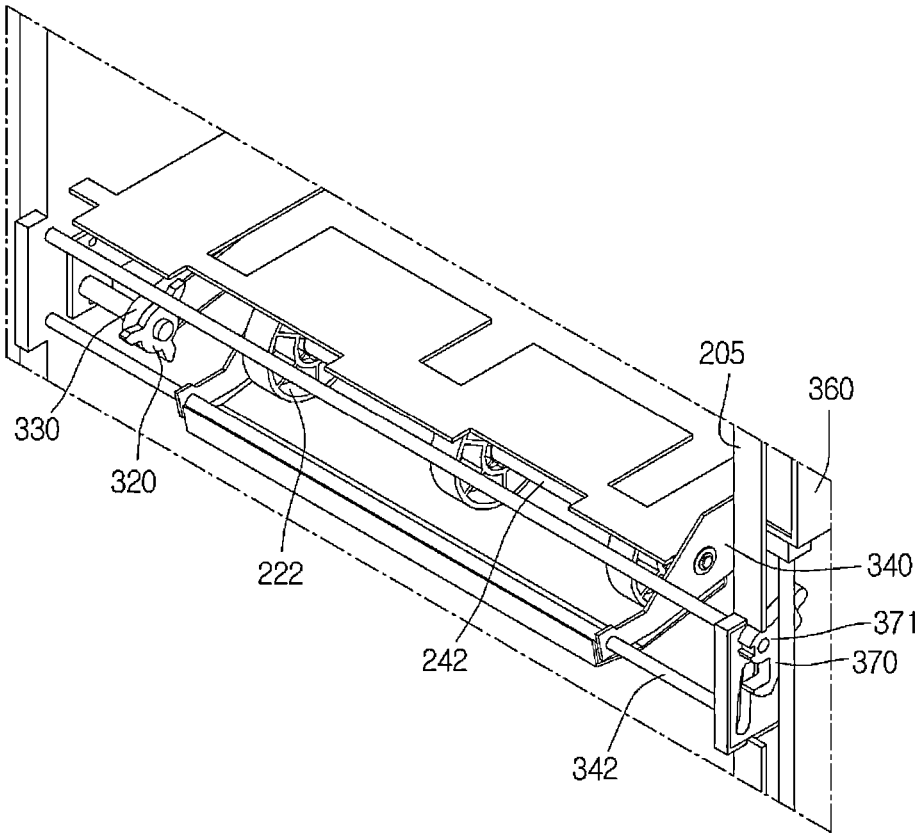
FIG. 14 is a view illustrating a pickup roller connected to a connecting member according still another embodiment.
Figure 15:
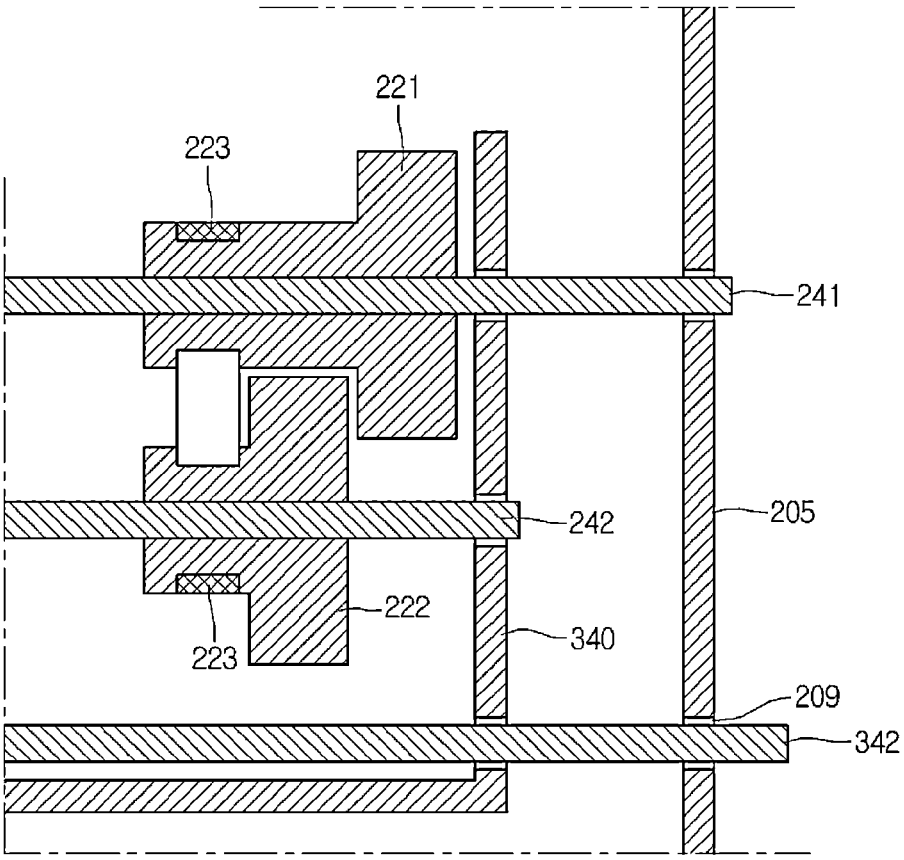
FIG. 15 is a view illustrating relation between a feed roller and the pickup roller according the present embodiment.

FIG. 13 is a schematic view illustrating an inner configuration of a medium storage box according to still another embodiment, FIG. 14 is a view illustrating a pickup roller connected to a connecting member according still another embodiment, and FIG. 15 is a view illustrating relation between a feed roller and the pickup roller according the present embodiment.

In the present embodiment, other parts are identical to those of another embodiment but there is a difference only in a configuration for moving the pickup roller. Accordingly, hereinafter, there will be described only particular parts of the still another embodiment.

Referring to FIGS. 13 to 15, in the present embodiment, the first rotation axis 241 of the first feed roller 221 and the second rotation axis 242 of the pickup roller 222 may penetrate a connecting member 340. Also, the first rotation axis 241 of the first feed roller 221 may penetrate the frame 205 included in the housing 200.

The connecting member 340 includes a projecting portion 342. The projecting portion 342 and the second rotation axis 242 of the pickup roller 222 are arranged side by side, and the projecting portion 342 may penetrate the frame 205. Also, on the frame 205, there may be formed a hole 209 where the projecting portion 342 penetrates.

The connecting member 340 may be rotated on the first rotation axis 241. To allow the connecting plate 230 to be rotated on the first rotation axis 241, the hole 209 may be formed to allow the projecting portion 342 to be transferable. Also, one end of an elastic member 350 may be connected to the projecting portion 342 and another end of the elastic member 350 may be connected to the frame 205. The elastic member 350 provides an elastic force to the projecting portion 342, the elastic force being capable of pulling the projecting portion 342 downwardly.

When the connecting member 340 is rotated on the first rotation axis 241, the second rotation axis 242 connected to the connecting member 340 may be rotated together with the connecting member 340. In other words, the height of the second rotation axis may vary.

On the other hand, in FIG. 13, to withdraw a second medium, the second supporting plate 212 may be moved downwardly toward the pickup roller 222. However, in this state, since the second rotation axis 242 is located lower than the first rotation axis 241 on the basis of a bottom surface of the housing 200, though the second supporting plate 212 descends, the pickup roller 222 may be in contact with the second medium on the second supporting plate 212. Accordingly, to pick up the second medium, the second rotation axis 242 of the pickup roller 222 may be moved by a pickup roller moving unit.

In detail, the pickup roller moving unit may include a clutch 300 connected to the first rotation axis 241 and a power transfer part, connected to the clutch 300, receiving and transferring a rotational force of the first rotation axis 241 to the projecting portion 342 of the connecting member 340. The clutch 300 is, as an example, an electronic clutch and may transfer power of the first rotation axis 341 to the power transfer part when turning on the clutch 300.

The power transfer part may include a transfer gear 310 connected to the clutch 300 and a rotating lever 320 connected to the transfer gear 310 by a transfer belt 330. The transfer gear 310 and the rotating lever 320 may include pulleys 312 and 322, respectively, the pulleys 312 and 322 where the transfer belt 330 is put on. Also, on a circumference of the rotating lever 320, there may be formed a plurality of protrusions 323. The plurality of protrusions 323 may be spaced apart from one another on the basis of a rotation center axis of the rotating lever 320 with a certain angle. In FIG. 13, as an example, the plurality of protrusions 323 are arranged on the rotation center axis of the rotating lever 320 with 120 degrees. However, in the present embodiment, the number of the plurality of protrusions 323 and an arrangement angle thereof may vary depending on the height of ascent of the projecting portion 342.

One of the plurality of protrusions 323 of the rotating lever 320 may be selectively in contact with the projecting portion 342 while the rotating lever 320 is being rotated and may lift the projecting portion 342 after being in contact with the projecting portion 342.

Meanwhile, the projecting portion 342 lifted by the rotating lever 320 may be fastened by a position fastening part 370. The position fastening part 370 may be connected to the frame 205 to be rotatable by a rotation axis 371. The position fastening part 370 may include a hook 372 where the projecting portion is held. Also, at a bottom of the hook 372, there may be provided a guiding surface 373 to allow the projection portion 342 to easily ascending along the hook 372. The guiding surface 373 may be an inclined surface.

The position fastening part 370 may be connected to the elastic member (not shown). The elastic member provides an elastic force to the position fastening part 370 in such a way that the hook 372 of the position fastening part 370 is rotated in a direction of holding the projecting portion 342.

The position fastening part 370 may include an extended portion 374. The extended portion 374 may be connected to a driving unit 360 for driving the position fastening part 370. The driving unit 360 may be, as an example, a solenoid and may include an operating bar 362 performing translational motion. Though there is not shown in the drawing, the operating bar 362 may be connected to the extended portion 374 by a pin. In this case, when the position fastening part 370 is rotated in a certain direction with a certain angle, not to transfer a rotational force, on the extended portion 374, there may be formed a groove or a hole formed in an arc shape where the pin is connected to. On the contrary, the driving unit 360 may be a motor. However, in the present embodiment, there is no limit in the kind of the driving unit 360.

Hereinafter, there will be described processes of accepting and withdrawing the first medium M1 and the second medium M2.

Figure 16:
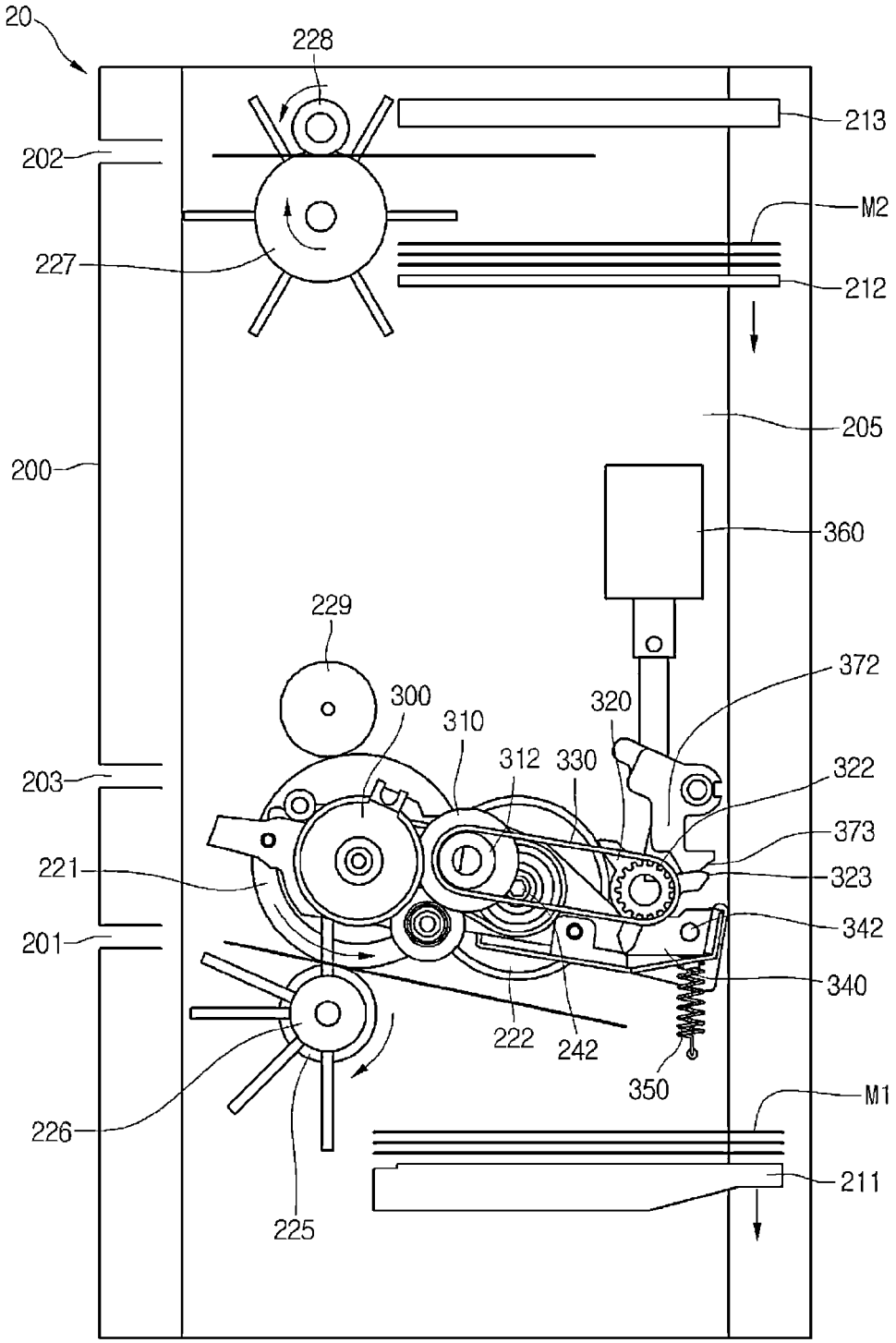
FIG. 16 is a view illustrating a process of accepting a first medium and a second medium according to still another embodiment.

FIG. 16 is a view illustrating the process of accepting the first medium M1 and the second medium M2 according to still another embodiment.

In FIG. 16, though it is shown that the first medium M1 and the second medium M2 are accepted in the medium storage box 20 simultaneously, any one of the first medium and second medium M1 and M2 may be accepted first and another thereof may be accepted later.

Referring to FIG. 16, the first medium M1 is accepted inside the housing 200 via the first path 201. The first medium M1 accepted inside the housing 200 is dropped on top of the first supporting plate 211 by the first feed roller 221 and the first gate roller 225. In this case, the first feed roller 221 is rotated counterclockwise and the first gate roller 225 is rotated clockwise in FIG. 16. Also, as the number of accepted first media M1 increases, the first supporting plate 211 may descend.

The second medium M2 is accepted inside the housing 200 via the second path 202. The second medium M2 accepted inside the housing 200 is dropped on top of the second supporting plate 212 by the second feed roller 227 and the second gate roller 228. In this case, the second feed roller 227 is rotated clockwise and the first gate roller 225 is rotated counterclockwise in FIG. 16. Also, as the number of the second media M2 increases, the second supporting plate 212 descends.

Figure 17:
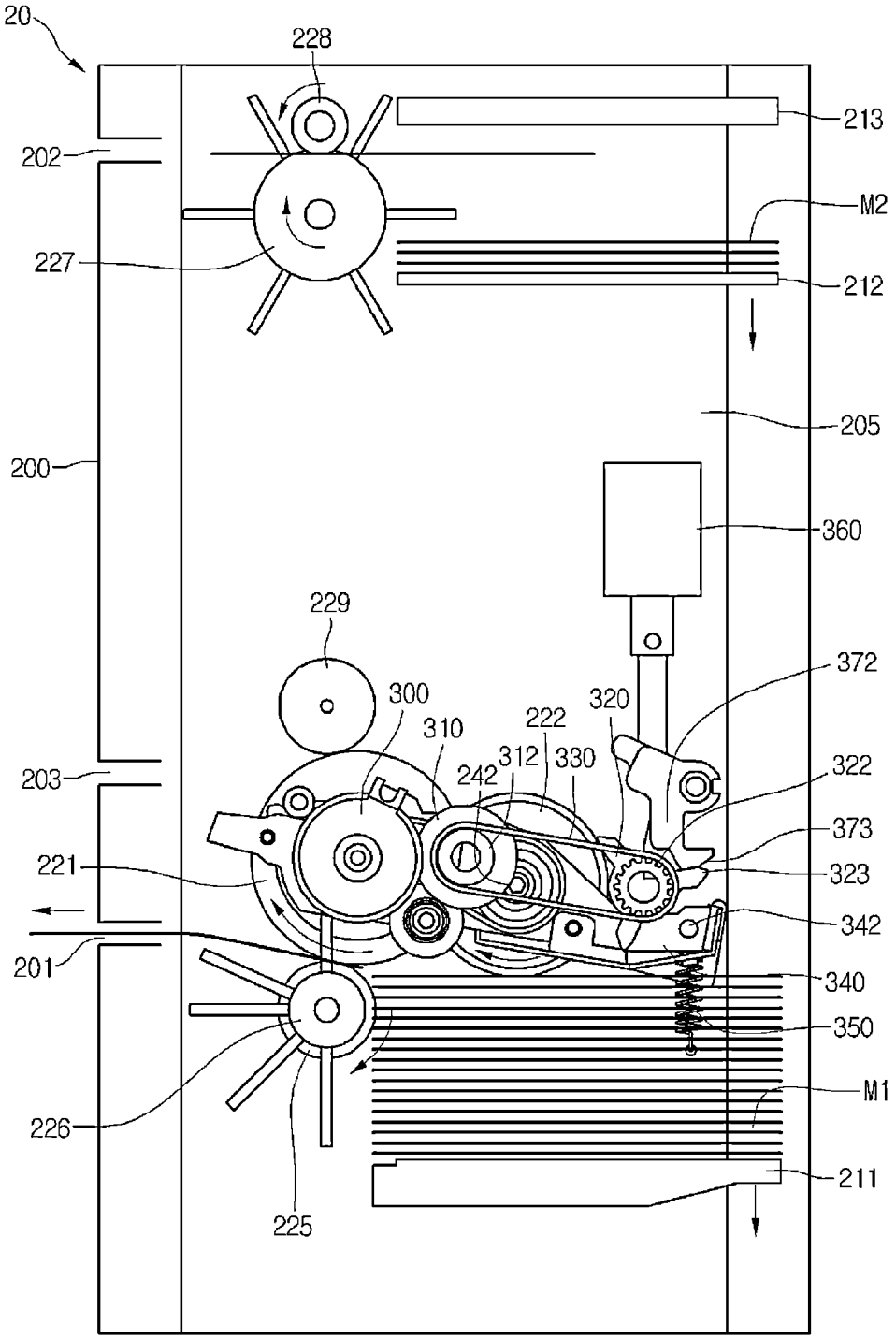
FIG. 17 is a view illustrating a process of withdrawing the first medium and inserting the second medium according to the present embodiment.

As shown in FIG. 16, while the first medium M1 is being accepted in the medium storage box 20, the clutch 300 is turned off in such a way that the rotational force of the first rotation axis 241 is not transferred to the transfer gear 310. When the first feed roller 221 is rotated counterclockwise, since the clutch 300 is turned off, the power transfer part maintains a state of being still. FIG. 17 is a view illustrating processes of withdrawing the first medium M1 and accepting the second medium M2.

Though the second medium M2 is accepted while withdrawing the first medium M1 in FIG. 17, any one of the withdrawal of the first medium M1 and the acceptation of the second medium M2 may be performed first and another one thereof may be performed later. Since a description of the process of accepting the second medium M2 with reference to FIG. 17 is the same as that described with reference to FIG. 16, it will be omitted.

Referring to FIG. 17, to withdraw the stored first medium M1, the first supporting plate 211 ascends. The first supporting plate 211 ascends until the first medium M1 on the first supporting plate 211 is in contact with the pickup roller 222. Then, the first medium M1 on the first supporting plate 211 is picked up by the pickup roller 222 one by one, and the picked up first medium M1 is withdrawn outside the housing 200 via the first path 201. In this case, in FIG. 17, the pickup roller 222 and the first feed roller 221 are rotated clockwise (a first direction). When withdrawing the first medium M1, the second rotation axis 242 is located lower than the first rotation axis 241.

When withdrawing the first medium M1, the clutch 300 is maintained to be turned off. Accordingly, the rotational force of the first rotation axis 241 is not transferred to the transfer gear 310.

Figure 18:
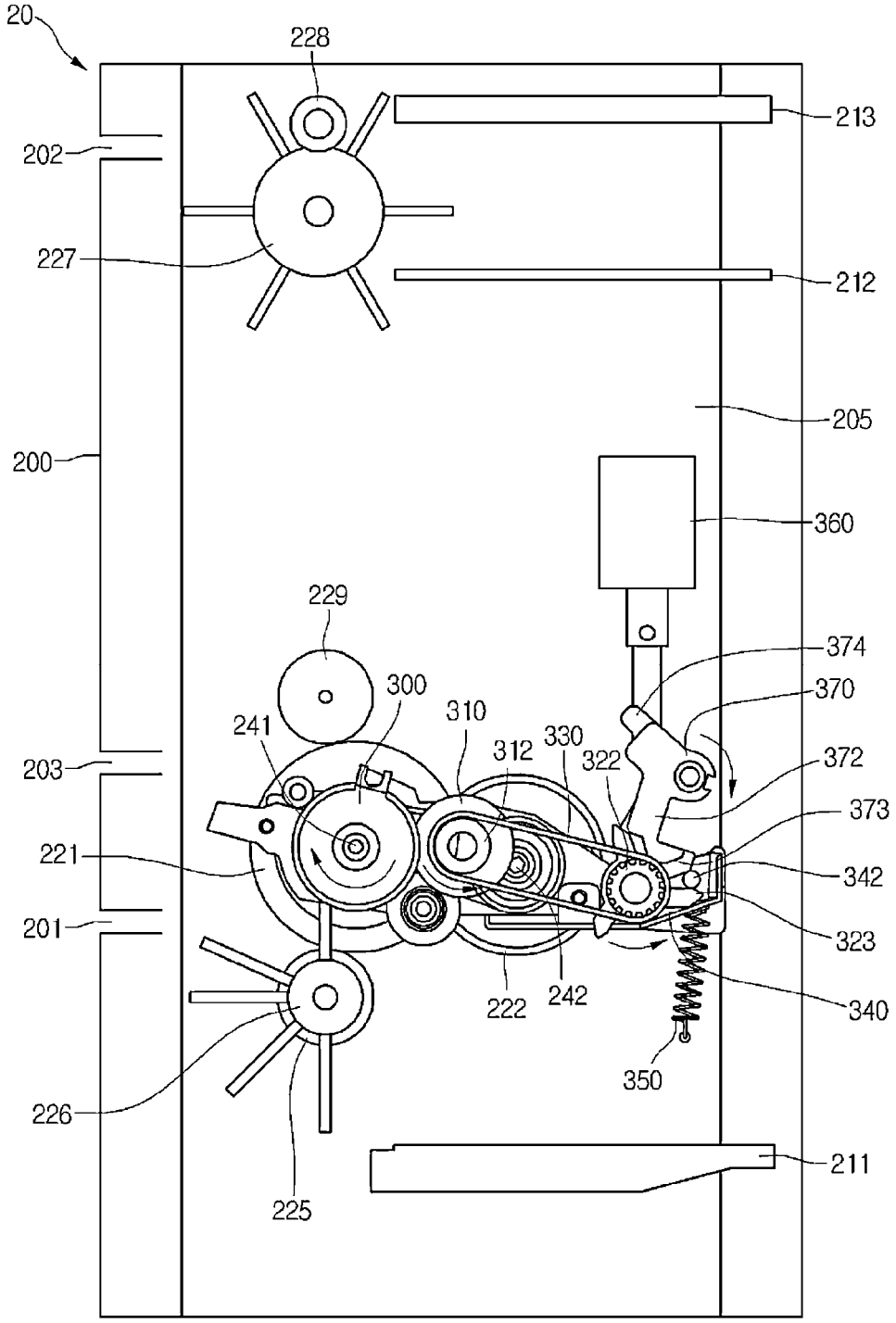
FIGS. 18 to 20 are views illustrating a process of withdrawing the second medium according to still another embodiment.
Figure 19:
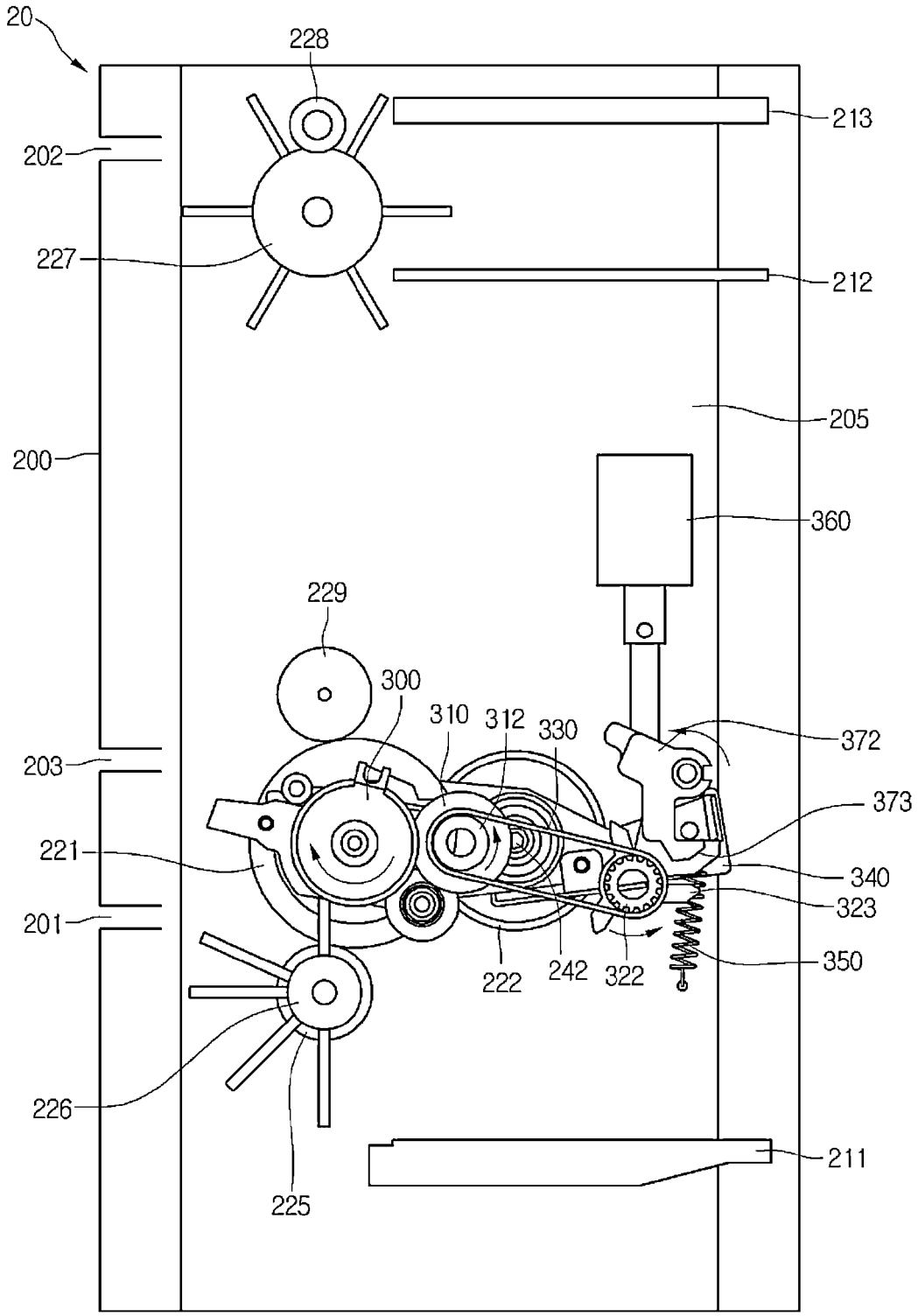
Figure 20:
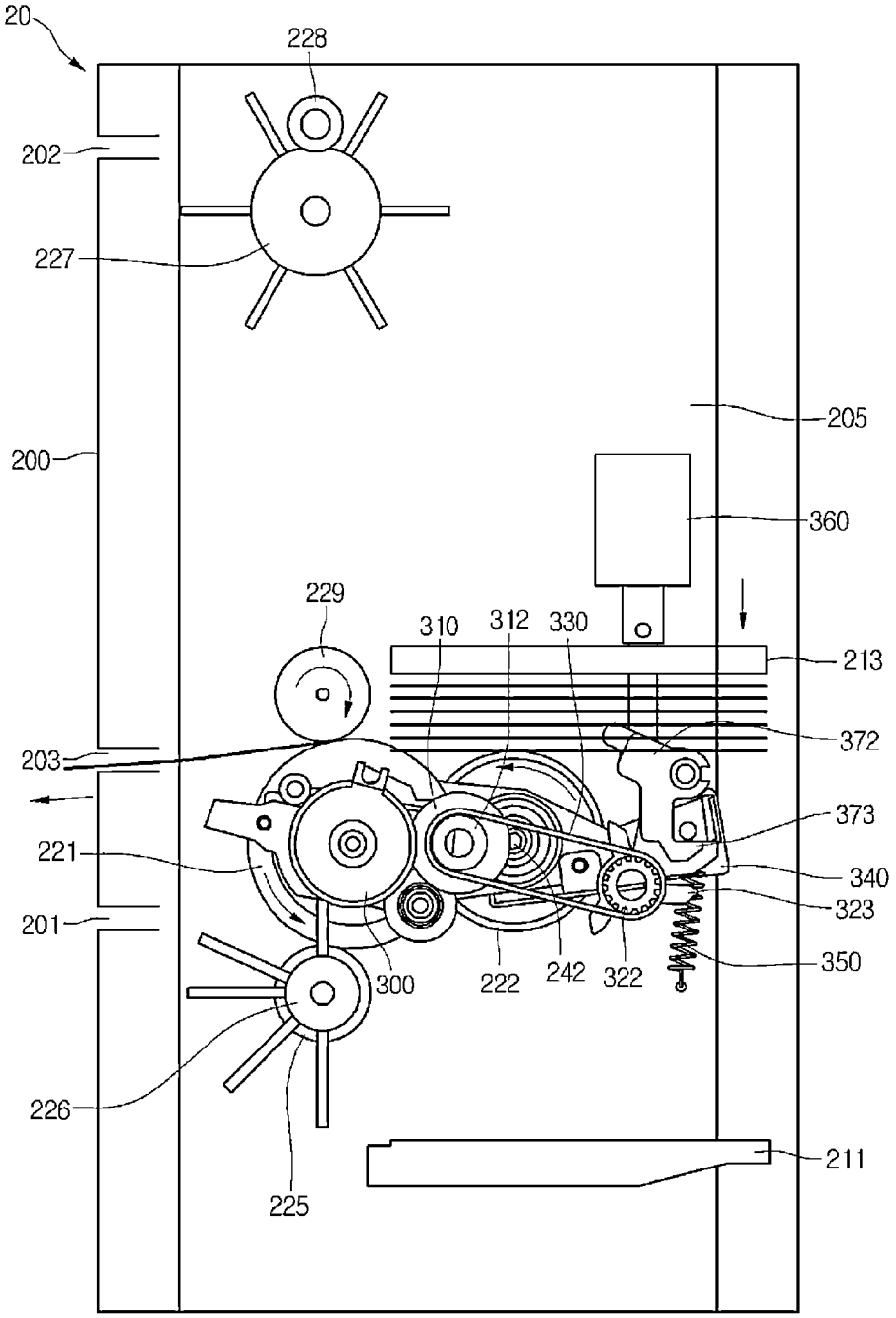
Figure 21:
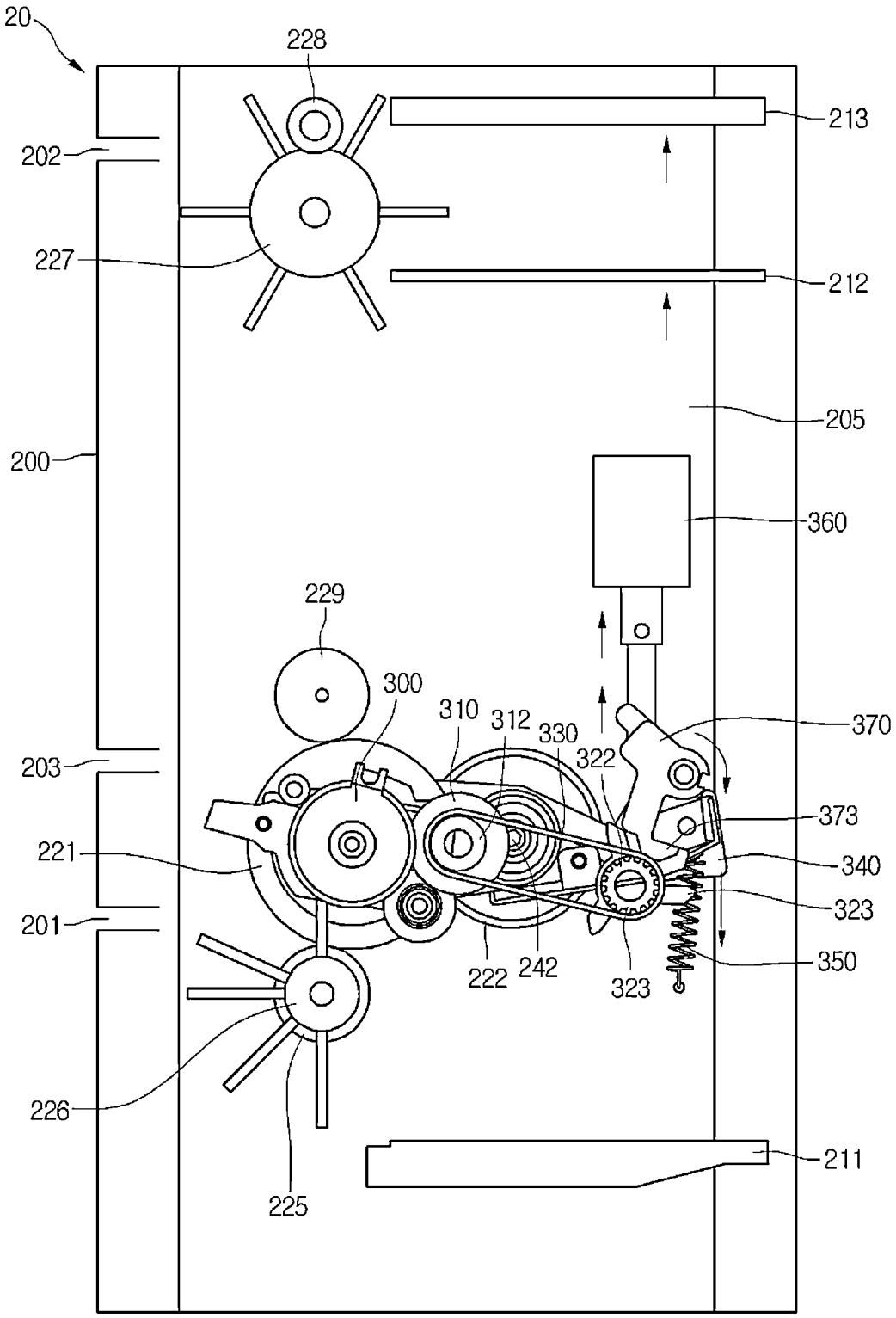
FIG. 21 is a view illustrating a state after completing a withdrawal of the second medium, in which a position fastening part is operated by a driving unit in such a way that a second rotation axis of a pickup roller descends.

FIGS. 18 to 20 are views illustrating a process of withdrawing the second medium M2 according to still another embodiment, and FIG. 21 is a view illustrating a state after completing the withdrawal of the second medium M2, in which a position fastening part 370 is operated by the driving unit 360 in such a way that the second rotation axis 242 of the pickup roller 222 descends.

Referring to FIG. 18, to withdraw the second medium M2, the first rotation axis 241 of the first feed roller 221 is rotated clockwise and the clutch 300 is turned on.

When the clutch 300 is turned on, due to the rotational force of the first rotation axis 241, the transfer gear 310 is rotated counterclockwise. When the transfer gear 310 is rotated counterclockwise, the transfer belt 330 is rotated counterclockwise, thereby rotating the rotating lever 320 counterclockwise. While the rotating lever 320 is being rotated counterclockwise, when any one of the plurality of protrusions 323 is in contact with the projecting portion 342 of the connecting member 340, the any one protrusion 323 lifts the projecting portion 342. When lifting the projecting portion 342, the connecting member 340 is rotated counterclockwise on the first rotation axis 241 and the second rotation axis 242 of the pickup roller 222 also ascends due to the rotation of the connecting member 340.

Referring to FIG. 19, while ascending, when the projecting portion 342 is in contact with the hook 372 of the position fastening part 370, the hook 372 is rotated clockwise. When the projecting portion 342 ascends to a certain height, the position fastening part 370 is rotated counterclockwise by the elastic member 350 in such a way that the projecting portion 342 is held by the hook 372.

After the projecting portion 342 is held by the hook 372, the rotation of the first feed roller 221 stops and the clutch 300 is turned off.

As described above, in a state where the pickup roller 222 ascends, the second supporting plate 212 is moved toward the pickup roller 222. In FIG. 19, the second supporting plate 212 descends toward the pickup roller 222.

On the second supporting plate 212, there is formed a hole (not shown) where the pickup roller 222 penetrates on a position corresponding to the pickup roller 222. Accordingly, when the second supporting plate 212 descends, the pickup roller 222 penetrates the hole and is in contact with the second medium M2. Accordingly, the second medium M2 may be picked up by the pickup roller 222.

In this case, to allow the pickup roller 222 to smoothly pick up the second medium M2, the pushing plate 213 descends and pushes the second medium M2 toward the pickup roller 222.

Then, finally, the second medium M2 is picked up by the pickup roller 222 one by one and the picked up second medium M2 is withdrawn outside the housing 200 via the third path 203.

In this case, the pickup roller 222 and the first feed roller 221 are rotated counterclockwise (a second direction) in FIG. 20 and the transfer roller 229 is rotated clockwise.

On the other hand, after an operation of picking up the second medium M2 is completed, as shown in FIG. 21, the position fastening part 370 is operated by the driving unit 360. That is, the operating bar 362 is moved upwardly, thereby rotating the position fastening part 370 clockwise. Then, the projecting portion 342 is released from the hook 372 of the position fastening part 370 and moved downwardly by a restoring force of the elastic member 350. Then, the connecting member 340 is rotated clockwise on the first rotation axis 241 and the pickup roller 222 returns to an original position as shown in FIG. 21. In this case, since the clutch 300 is turned off, the first rotation axis 241 maintains a state of being still.

In this case, in the present embodiment, a completion of picking up the second medium M2 may be sensed by a sensor (not shown). When the sensor senses that picking up a designated number of second media M2 is completed, the position fastening part 370 is operated by the driving unit 360 in such a way that a pickup roller unit is moved downwardly.

After completing the picking up operation of the pickup roller 222, there may occur a problem in which one of the second media M2, not to be picked up, is picked up by the pickup roller 222 due to rotational inertia thereof and is caught between the first feed roller 221 and the transfer roller 229. However, according to the present embodiment, since the position fastening part 370 is operated and the pickup roller unit is moved downwardly after completing the pickup operation of the pickup roller 222, though the pickup roller 222 is rotated due to inertial force, there may be prevented additionally picking up the second medium M2. Also, also in FIG. 17, the completion of picking up the first medium M1 by the pickup roller 222 may be sensed by a sensor (not shown). When the sensor senses that picking up a designated number of the first media M1 is completed, the first rotation axis 241 of the first feed roller 221 is rotated clockwise in such a way that the pickup roller unit is moved upwardly. Accordingly, though the pickup roller 222 is rotated due to inertial force, there may be prevented additionally picking up the first medium M1.

According to the present embodiment, since one of the first medium M1 and the second medium M2 may be picked up by the single pickup roller 222, there is not needed an additional pickup roller, thereby increasing capacity of storing media in the medium cassette 20 and simplifying the inner configuration thereof.

In the present embodiment, among elements of the medium still 20, a configuration including at least a plurality of medium storage spaces, a plurality of supporting plates, and a pickup roller may be designated as a medium handling apparatus.

Also, in the present specification, a pickup roller, a connecting member, and a projecting portion are commonly designated as a pickup roller unit. Also, a position of the pickup roller unit when accepting or withdrawing a first medium may be designated as a first position, and a position of the pickup roller unit when accepting or withdrawing a second medium may be designated as a second position. Also, a pickup roller moving unit may change a position of the pickup roller unit according to the kind of media to be picked up.

Also, though the pickup roller moving unit moves the pickup roller unit to pick up the second medium and the pickup roller unit is moved downwardly by a self-weight thereof when releasing the pickup roller unit from a fastening part in the present embodiment, different thereto, the fastening part may be not provided and the pickup roller unit may be moved (rotated) in one direction and then may be moved (rotated) in another direction by the pickup roller moving unit.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or includes or has) some elements, it should be understood that it may comprise (or include or has) only those elements, or it may comprise (or include or have) other elements as well as those elements if there is no specific limitation. Unless otherwise specifically defined herein, all terms including technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A medium storage box comprising:

a first supporting plate for storing a first medium;

a second supporting plate spaced apart from the first supporting plate, for storing a second medium;

a pickup roller, disposed between the first supporting plate and the second supporting plate, for selectively picking up one of the first medium and the second medium;

a first feed roller to withdraw the first medium or the second medium picked up by the pickup roller;

a pickup roller moving unit receiving a power transmitted from the first feed roller to move the pickup roller toward the second supporting plate for picking up the second medium by the pickup roller, and comprising a first power transfer device transferring the power transmitted from the first feed roller to the pickup roller moving unit; and a second power transfer device transferring a power transmitted from the first feed roller to the pickup roller;

wherein the first power transfer device comprises a clutch connected to the first feed roller for receiving the power from the first feed roller, wherein the clutch is maintained to be turned off when the pickup roller picks up the first medium, and wherein the clutch is turned on such that the pickup roller moves toward the second medium to pick up the second medium.

2. The medium storage box of claim 1, wherein the first supporting plate is located below the pickup roller, wherein the second supporting plate is arranged above the pickup roller, and wherein the second supporting plate is provided with a hole where the pickup roller penetrates.

3. The medium storage box of claim 2, further comprising a pushing plate pushing the second medium on the second supporting plate toward the pickup roller to pick up the second medium.

4. The medium storage box of claim 1, further comprising:

a connecting plate connected to a rotation axis of the pickup roller; and an elastic member providing an elastic force to the connecting plate, the elastic force allowing the rotation axis to be moved toward the first supporting plate.

5. The medium storage box of claim 4, wherein, when the second medium is withdrawn, the first supporting plate provides a pushing force toward the pickup roller in such away that the rotation axis is rotated together with the connecting plate, and wherein the connecting plate is fastened by a fastening part at a position where the connecting plate is moved.

6. The medium storage box of claim 1, further comprising:

a second feed roller for accepting the first medium; and a third feed roller for accepting the second medium, wherein, when the second medium is withdrawn, the second feed roller is rotated in the same direction as that of the pickup roller to allow the second medium to be withdrawn.

7. The medium storage box of claim 1, wherein, when the first medium is withdrawn, the pickup roller is rotated in a first direction, and wherein, when the second medium is withdrawn, the pickup roller is rotated in a second direction opposite to the first direction.

8. The medium storage box of claim 1, further comprising:

a connecting member to which a rotation axis of the pickup roller is connected; and a projecting portion formed on the connecting member, wherein the pickup roller moving unit moves the projecting portion.

9. The medium storage box of claim 8, wherein the first power transfer device further comprises:

a power transfer part, connected to the clutch, for transferring the received power to the projecting portion.

10. The medium storage box of claim 9, wherein the power transfer part comprises a rotating lever to be rotatable, and wherein, on a circumference of the rotating lever, a plurality of protrusions protruded in a radial direction is formed.

11. The medium storage box of claim 9, further comprising:

a rotation axis to which the first feed roller is connected, wherein the clutch is connected to the rotation axis of the first feed roller.

12. The medium storage box of claim 11, wherein, when the first medium is withdrawn, the rotation axis of the first feed roller is rotated in a first direction, and wherein, when operating the first power transfer device, the rotation axis of the first feed roller is rotated in the first direction and the clutch is turned on.

13. The medium storage box of claim 9, further comprising:

a position fastening part for fastening the moved pickup roller at a predetermined position; and a driving unit for driving the position fastening part.

14. The medium storage box of claim 13, wherein the position fastening part comprises a hook for holding the projecting portion, and wherein, when being held by the hook, the projecting portion is released from the hook by driving of the driving unit.

15. A medium handling apparatus comprising:

a plurality of medium storage spaces;

first and second supporting plates, provided in the plurality of medium storage spaces, the first supporting plate for supporting a first medium and the second supporting plate for supporting a second medium;

a pickup roller, to be relatively movable with the first and second supporting plates, and for selectively picking up a first medium or a second medium respectively supported by the first and second supporting plates;

a pickup roller moving unit configured to move the pickup roller toward the second supporting plate to pick up the second medium, the pickup roller moving unit comprising a connecting plate to which a rotation axis of the pickup roller is coupled; and a fasten device to fasten a position of the connecting plate when the connecting plate is rotated in a first direction toward the second supporting plate, wherein the fasten device is detached from the connecting plate when the connecting plate is rotated in a second direction opposite to the first direction, and wherein the fasten device is connected to the connecting plate when the connecting plate is rotated in the first direction.

16. The medium handling apparatus of claim 15, wherein the pickup roller is rotated in a first direction and picks up the first medium stored in one of the plurality of medium storage spaces; and wherein the pickup roller is rotated in a second direction opposite to the first direction and picks up the second medium stored in another medium storage space of the plurality of medium storage spaces.

17. A medium storage box comprising:

a first medium storage space and a second medium storage space;

a first supporting plate disposed in the first medium storage space to support a first medium;

a second supporting plate disposed in the second medium storage space to support a second medium, wherein the second medium is stacked on an upper surface of the second supporting plate;

a pickup roller, movable with respect to the first and second supporting plates, selectively picking up the first medium or the second medium supported by the first supporting plate or the second supporting plate, respectively;

a first feed roller and a first gate roller to transfer the first medium picked up by the pickup roller and to transfer the first medium to be stacked on the first supporting plate;

a first sheet roller connected to a rotational shaft of the first gate roller, wherein the first sheet roller comprises a body connected to the rotational shaft of the first gate roller and a plurality of wings extended from the body in a radial direction of the body to hit the first medium, the plurality of wings being spaced apart from each other;

a second feed roller to transfer the second medium to be stacked on the second supporting plate; and a pushing plate pushing the second medium on the second supporting plate toward the pickup roller to pick up the second medium;

wherein when the second medium is accepted in the second medium storage space, the pushing plate is spaced apart from the second supporting plate such that the second medium is stacked on the upper surface of the second supporting plate; and wherein when the second medium is picked up by the pickup roller, the pushing plate moves toward the second medium and pushes the second medium toward the pickup roller.

18. The medium storage box of claim 17, wherein the second feed roller is spaced apart from the pickup roller.

19. The medium storage box of claim 17, wherein the first feed roller transfers the second medium picked up by the pickup roller.

20. The medium storage box of claim 17, further comprising a a second sheet roller to transfer the second medium to be stacked on the second supporting plate, and a transfer roller to transfer the second medium picked up by the pickup roller.

21. The medium storage box of claim 17, further comprising a second sheet roller connected to a rotational shaft of the second feed roller.

* * * * *